US007406851B2

(12) United States Patent
Shiroza et al.

(10) Patent No.: US 7,406,851 B2
(45) Date of Patent: Aug. 5, 2008

(54) DIE CUSHION CONTROLLING APPARATUS AND DIE CUSHION CONTROLLING METHOD

(75) Inventors: Kazuhiko Shiroza, Ishikawa (JP); Yukiyoshi Takayama, Ishikawa (JP); Hiroaki Honma, Ishikawa (JP); Seiji Seki, Ishikawa (JP)

(73) Assignees: Komatsu Ltd., Tokyo (JP); KOMATSU Industries Corp., Tokyo (JP)

( * ) Notice: Subject to any disclaimer, the term of this patent is extended or adjusted under 35 U.S.C. 154(b) by 297 days.

(21) Appl. No.: 11/151,211

(22) Filed: Jun. 14, 2005

(65) Prior Publication Data

US 2005/0274243 A1 Dec. 15, 2005

(30) Foreign Application Priority Data

Jun. 14, 2004 (JP) ..... 2004-175581
Jun. 8, 2005 (JP) ..... 2005-168519

(51) Int. Cl.
*B21D 22/00* (2006.01)
*B21C 51/00* (2006.01)
*B21J 9/18* (2006.01)

(52) U.S. Cl. ..... 72/351; 72/21.5; 72/453.13

(58) Field of Classification Search ..... 72/19.9, 72/20.1, 21.4, 21.5, 351, 453.01, 453.13, 72/30.1, 20.2, 20.4, 453.06; 700/206
See application file for complete search history.

(56) References Cited

U.S. PATENT DOCUMENTS 4,945,742 A * 8/1990 Schoch ..... 72/17.2
5,299,444 A * 4/1994 Kirii et al. ..... 72/453.13
5,435,166 A * 7/1995 Sunada ..... 72/351
5,687,598 A * 11/1997 Kirii et al. ..... 72/21.5
2005/0262915 A1 * 12/2005 Baba ..... 72/351

FOREIGN PATENT DOCUMENTS

JP 10-202327 8/1998

* cited by examiner

*Primary Examiner*—Derris H. Banks
*Assistant Examiner*—Teresa Bonk
(74) *Attorney, Agent, or Firm*—Posz Law Group, PLC

(57) ABSTRACT

A die cushion controlling apparatus for controlling an operation of a cushion pad, which comprises a pad drive mechanism for driving to raise or lower the cushion pad while applying an upward energizing force, a load measuring unit for measuring a load generated in the cushion pad, a time detecting unit for detecting a generating time and a vanishing time of the load, and a control unit for controlling the pad drive mechanism so that a load measured value measured by the load measuring unit follows a preset load pattern during a period from when the time detecting unit detects the generating time of the load until when the time detecting unit detects the vanishing time of the load.

7 Claims, 18 Drawing Sheets

DIE CUSHION CONTROLLING APPARATUS AND DIE CUSHION CONTROLLING METHOD

BACKGROUND OF THE INVENTION

1. Field of the Invention

The present invention relates to a die cushion controlling apparatus and a die cushion controlling method which controls an operation of a cushion pad synchronously with an operation of a slide of a press machine.

2. Description of the Related Art

In a press machine, a die cushion apparatus (hereinafter merely referred to as a "die cushion") is provided for controlling folds in a throttling work. A conventional die cushion generates a cushion pressure while driving to raise or lower a cushion pad by using a hydraulic pressure or an air pressure. In order to raising throttling workability of the press machine and prevent a work from being broken or strained, it is necessary to control the cushion pressure of the die cushion in high accuracy, and particularly, it is necessary to control the cushion pressure at the time of lowering operation of the cushion pad in high accuracy.

The die cushion using only the air pressure cannot control the cushion pressure in high accuracy at the time of operating the cushion pad. The die cushion using the hydraulic pressure can control the cushion pressure in high accuracy at the time of operating the cushion pad under the control of a hydraulic pressure. However, there is a drawback that the structure of a hydraulic apparatus is complicated, and severe maintenance and management is required. Therefore, recently, a die cushion having an electric servomotor which has a simple structure and which does not need severe maintenance and management is noted.

In Japanese Patent Application Laid-Open No. 10-202327, a control technology of a die cushion having a rotary electric servomotor is disclosed. FIG. 18 is a view showing a conventional press machine and its control system.

In the press machine shown here, a slide 2 is coupled to an eccentric portion of a crankshaft in a slide drive mechanism 1. The slide 2 is raised or lowered in response to a rotation of the crankshaft. An encoder is provided in the crankshaft, and a signal is outputted from the encoder to a controller 100 in response to the rotation of the crankshaft. The controller 100 obtains a position of the slide 2 by using this signal.

Also, in the die cushion shown here, the output shaft of the servomotor 16 is coupled to a screw portion 112*b* of a ball screw 112, and this screw portion 112*b* is screwed into the cushion pad 11. When the screw portion 112*b* of the ball screw 112 rotates in response to the rotation of the servomotor 16, the cushion pad 11 is raised and lowered along the screw portion 112*b*. The servomotor 16 is provided with an encoder and a signal is outputted from the encoder 19 to the controller 100 in accordance with the rotation of the servomotor 16. The controller 100 obtains a position of the cushion pad by using this signal.

At an initial time of one stroke operation of the slide 2 from a top dead point, the controller 100 controls the position of the cushion pad 11 in accordance with the position of the slide 2. By this control, the cushion pad 11 is lowered at a lower speed than a lowering speed of the slide 2 and operated so that an upper die 3*a* is contacted with a work 4 at a predetermined position. When the upper die 3*a* is contacted with the work 4, the cushion pad 11 starts receiving a load of the slide 2. At this time, a current value of the servomotor 16 is changed. When this current change is detected, the controller 100 obtains a cushion pressure based on the current value, and controls the servomotor 16 so that the obtained cushion pressure follows the pressure pattern of the preset cushion pressure. Then, the cushion pad 11 lowers while generating an upward energizing force, and reaches a bottom dead point.

An error of the control affects to throttling workability, and causes the work 4 to be broken or strained. Therefore, the controller 100 needs to control the operation of the cushion pad 11 so that the obtained cushion pressure follows to the set pressure pattern.

With respect to an accuracy of the operation of the cushion pad, the above-mentioned Japanese Patent Application Laid-Open No. 10-202327 has a problem. Generally, a feedback control must be a closed loop for measuring a physical amount in a control object and controlling the control object based on its measured value. If the feedback control of the cushion pressure of the cushion pad is performed, it is necessary to measure the load generated in the cushion pad.

However, in the above-mentioned Japanese Patent Application Laid-Open No. 10-202327, no physical amount is measured from the cushion pad side, and the current value of the servomotor for driving the cushion pad is merely measured. Though the load generated in the cushion pad and the current value of the servomotor have a certain relative relation, but it cannot be said that they always have a predetermined relationship. Therefore, it is severely said that the feedback control of the above-mentioned Japanese Patent Application Laid-Open No. 10-202327 does not become a closed loop. In the technology of the Japanese Patent Application Laid-Open No. 10-202327 from such a point, there is possibility of being not able to accurately control the operation of the cushion pad. In the worst case, the work generates a breakage or a strain.

The present invention is made in view of the above-mentioned circumstances, and aims to solve the problem by performing the feedback control of the cushion pressure in a closed loop and controlling a cushion pressure of a cushion pad in high accuracy.

SUMMARY OF THE INVENTION

A first aspect of the present invention is a die cushion controlling apparatus for controlling an operation of a cushion pad, comprising:

a pad drive mechanism for driving to raise or lower the cushion pad while applying an upward energizing force;

a load measuring unit for measuring a load generated in the cushion pad;

a time detecting unit for detecting a generating time and a vanishing time of the load; and a control unit for controlling the pad drive mechanism so that a load measured value measured by the load measuring unit follows a preset load pattern during a period from when the time detecting means detects the generating time of the load until when the time detecting means detects the vanishing time of the load.

A second aspect of the present invention is the die cushion controlling apparatus according to the first aspect of the invention, wherein the load measuring unit further comprises a strain gauge for measuring a strain of the cushion pad or a support for supporting the cushion pad, and wherein the load measuring unit obtains a value corresponding to the load by using a measured result of the strain gauge.

A third aspect of the present invention is the die cushion controlling apparatus according to the first aspect of the invention, wherein the load measuring unit further comprises a hydraulic chamber interposed between the cushion pad and the pad drive mechanism, and a pressure sensor for measuring a pressure in the hydraulic chamber, and wherein the load measuring unit obtains a value corresponding to the load by using a measured result of the pressure sensor.

The first to the third aspects of the present invention will be described.

The upper die is provided in the lower portion of the slide of the press machine, and the work is provided above the cushion pad of the die cushion. When the upper die is contacted with the work as the slide is operated to be lowered, the load caused by the weight of the slide is generated in the cushion pad. The cushion pad is lowered to a bottom dead point synchronously with the cushion pad while generating an upward energizing force by the drive force of the servomotor (pad drive mechanism).

The strain gauge is adhered to the side face of the cushion pad. The pressure generated in the cushion pad, that is, the cushion pressure is measured as the load by this strain gauge (load measuring unit). The measured value of the strain gauge is outputted to the pad controller. When the pressure is generated in the cushion pad, the measured value of the strain gauge becomes a predetermined value or more. In the pad controller, this time is detected and it is judged that the slide is operated to be lowered and the upper die is contacted with the work. Also, when the pressure of the cushion pad is vanished, the measured value of the strain gauge becomes a predetermined value or less. In the pad controller, this time is detected, and it is judged that the slide is changed to the raising operation from the bottom dead point (time detecting unit). In the pad controller, a pressure pattern of the cushion pressure is previously set. During a period from the load generating time to the vanishing time, the pad controller compares the measured pressure value with the set pressure pattern, and controls the servomotor so that the pressure value follows the pressure pattern (control unit).

Instead of the strain gauge, a pressure sensor may be used to measure the load generated in the cushion pad. In such a case, a hydraulic chamber is provided in a portion, where the weight of the cushion pad is received, of a power transmission route between the servomotor and the cushion pad. The pressure in the hydraulic chamber is measured by this pressure sensor.

According to the first to the third aspects of the present invention, a value showing the load from the cushion pad, which is an object to be controlled, is directly measured, and feedback control is performed.

A fourth aspect of the present invention is the die cushion controlling apparatus according to the first aspect of the invention, wherein a plurality of the cushion pads, the pad drive mechanisms, the load measuring units and the control units are provided in one working station of a press machine, and operations of the respective cushion pads are controlled independently.

The fourth aspect of the present invention will be described.

A plurality of the pads are provided in one working station of the press machine.

The strain gauge is adhered to the side face of each cushion pad, and the pressure generated in the corresponding cushion pad, that is, the cushion pressure is measured as the load by this strain gauge. The measured value of the strain gauge is outputted to the pad controller. In the pad controller, the pressure pattern of the cushion pressure corresponding to each cushion pad is previously set. The pad controller compares the measured pressure value with the set pressure pattern, and controls the corresponding servomotor so that the pressure value follows the pressure pattern.

According to the fourth aspect of the present invention, a value showing the load is directly measured from each cushion pad, which is an object to be controlled, and the individually independent feedback control is performed for each cushion pad.

A fifth aspect of the present invention is a die cushion controlling method for controlling an operation of a cushion pad, comprising:

a position control step of measuring a position of the cushion pad and controlling the position of the cushion pad so that a position measured value follows a preset position pattern; and a load control step of measuring a load generated in the cushion pad and controlling the load generated in the cushion pad so that a load measured value follows a preset load pattern, wherein:

the position control step is switched to the load control step at a time when the load starts to be generated in the cushion pad.

The fifth aspect of the present invention will be described.

In the press machine, a preliminary acceleration is performed to alleviate an impact when the upper die is contacted with the work. The position of the cushion pad is measured during this preliminary acceleration, this position measured value is compared with the preset position pattern, and so called position feedback control is performed for controlling the servomotor so that the position measured value follows the position pattern.

When the upper die is contacted with the work, the load starts generating in the cushion. After the load generated in the cushion pad is detected or the cushion pad reaches the position where the upper die is contacted with the work, the load generated in the cushion pad is measured, this load measured value is compared with the preset load pattern, and so called the pressure feedback control is performed for controlling the servomotor so that the load measured value follows the preset load pattern.

As described above, the position feedback control is switched to the pressure feedback control at the time when the upper die contacts with the work.

According to the fifth aspect of the present invention, the value showing the position is measured directly from the cushion pad, which is the object to be controlled, during the preliminary acceleration, and the feedback control is performed. After the preliminary acceleration, the value showing the load is measured directly from the cushion pad, which is the object to be controlled, and the feedback control is performed.

According to the present invention, since the pressure feedback control of the closed loop for feeding back the cushion pressure measured from the cushion pad itself is performed at a timing at which the pressure feedback control of the cushion pad is required, the cushion pressure of the cushion pad can be controlled in high accuracy. Therefore, the workability of the press can be improved.

According to the fourth aspect of the present invention, since the cushion pressure in one working station can be partly changed, the accuracy of the press machine can be further improved.

BRIEF DESCRIPTION OF THE DRAWINGS

Embodiments of the present invention will be described in detail based on the following figures, wherein.

DETAILED DESCRIPTION OF THE INVENTION

Embodiments of the present invention will be described in detail with reference to the accompanying drawings.

Figure 1:
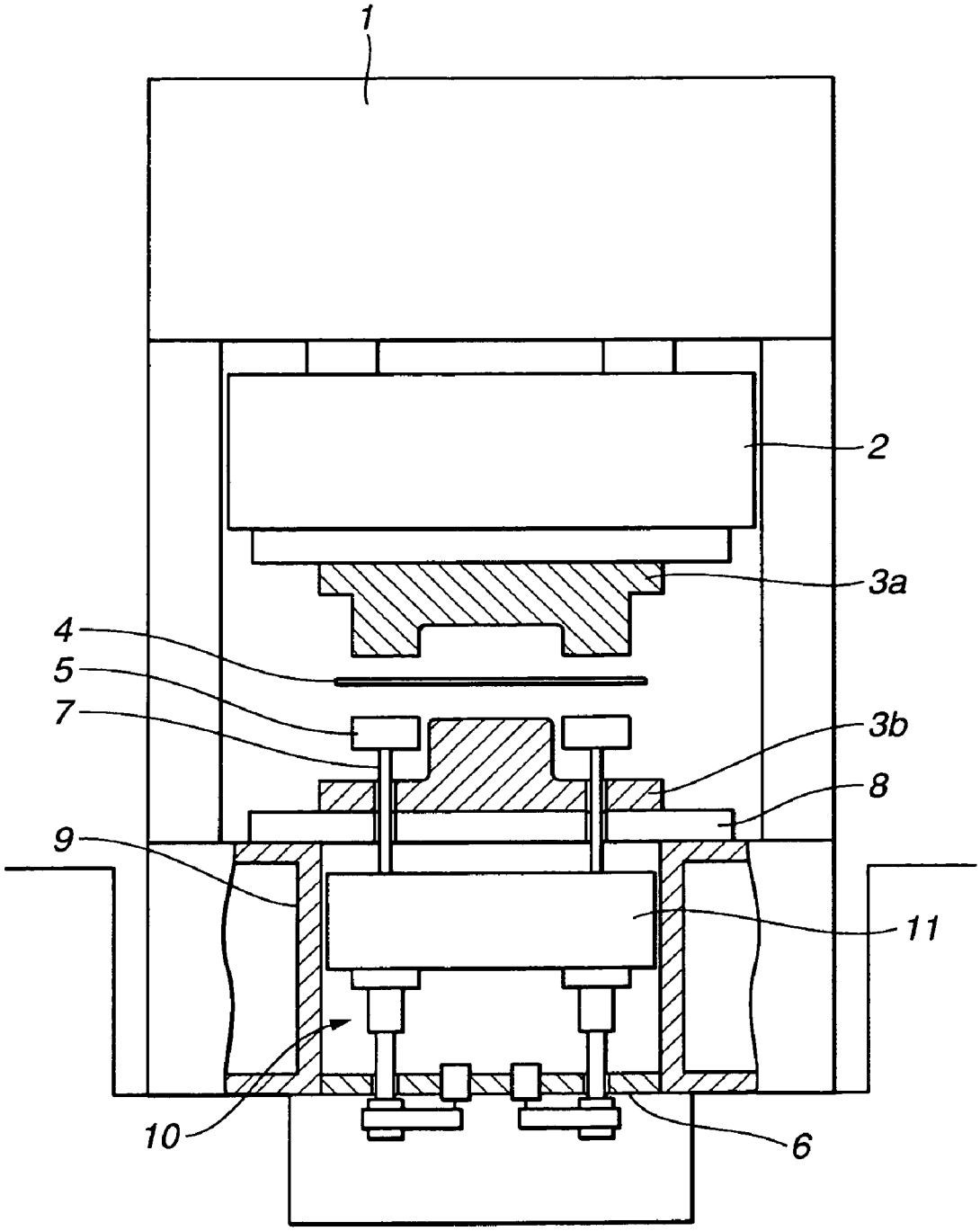
FIG. 1 is a schematic view showing a structure of a press machine.

FIG. 1 is a schematic view showing a structure of a press machine.

In the press machine, a slide 2 disposed in an upper portion and a bolster 8 disposed in a lower portion are provided oppositely to each other. The slide 2 is raised or lowered by receiving a power from a slide drive mechanism 1 located above the slide 2. An upper die 3*a* is mounted on the lower portion of the slide 2. On the other hand, the bolster 8 is fixed to an upper portion of a bed 9, and a lower die 3*b* is mounted on an upper portion of the bolster 8. A plurality of holes are provided vertically in the bolster 8 and the lower mold 3*b*. Cushion pins 7 are respectively inserted into these holes. An upper end of the cushion pin 7 is contacted with the lower portion of a blank holder 5 provided in a recess portion of the lower die 3*b*, and a lower end of the cushion pin 7 is contacted with a cushion pad 11 of a die cushion 10 provided in the bed 9. A beam 6 is provided between inner wall surfaces of the bed 9, and the die cushion 10 is supported by the beam 6.

First Embodiment

Figure 2:
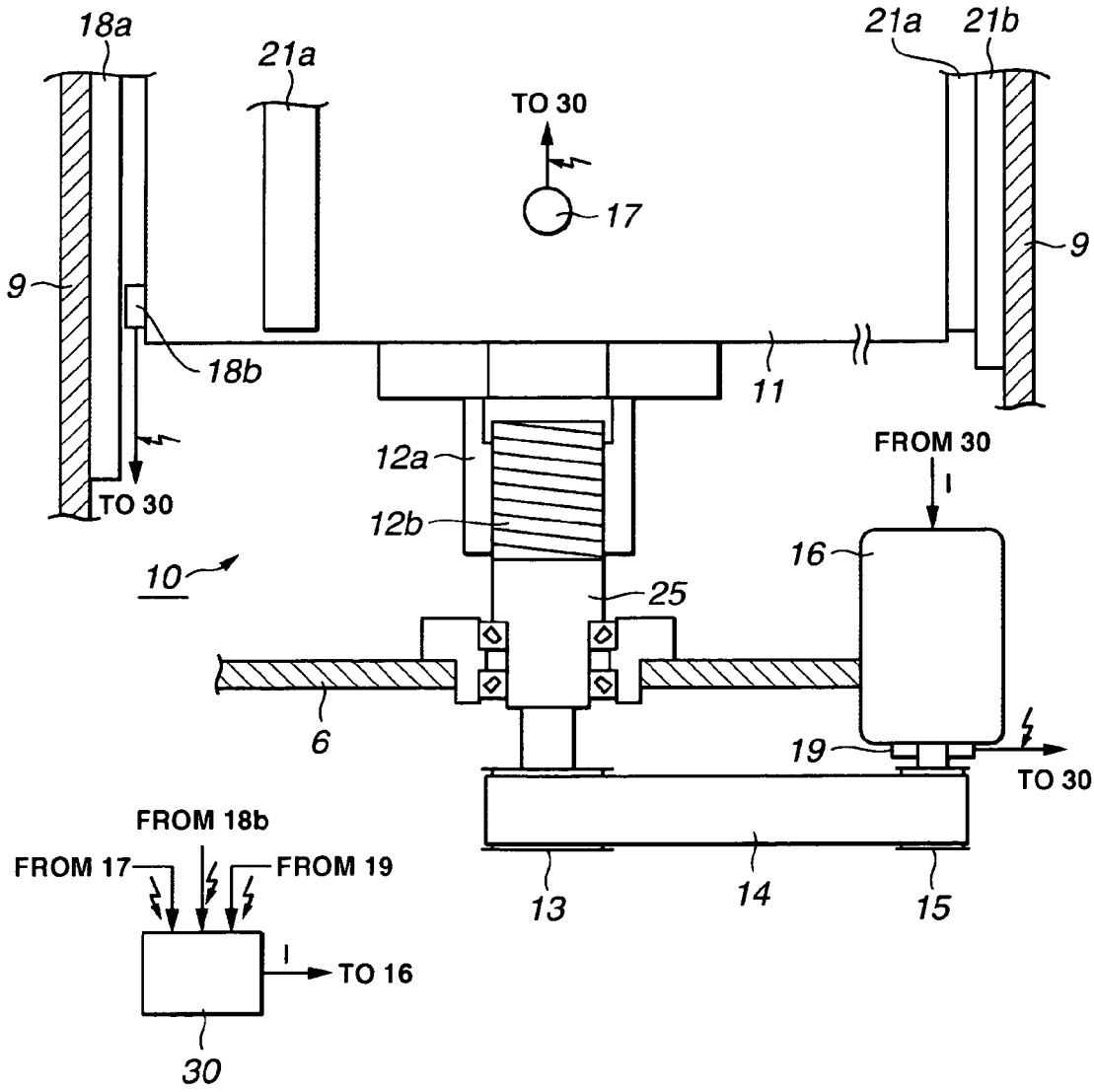
FIG. 2 is a schematic view of a die cushion according to a first embodiment.
Figure 3:
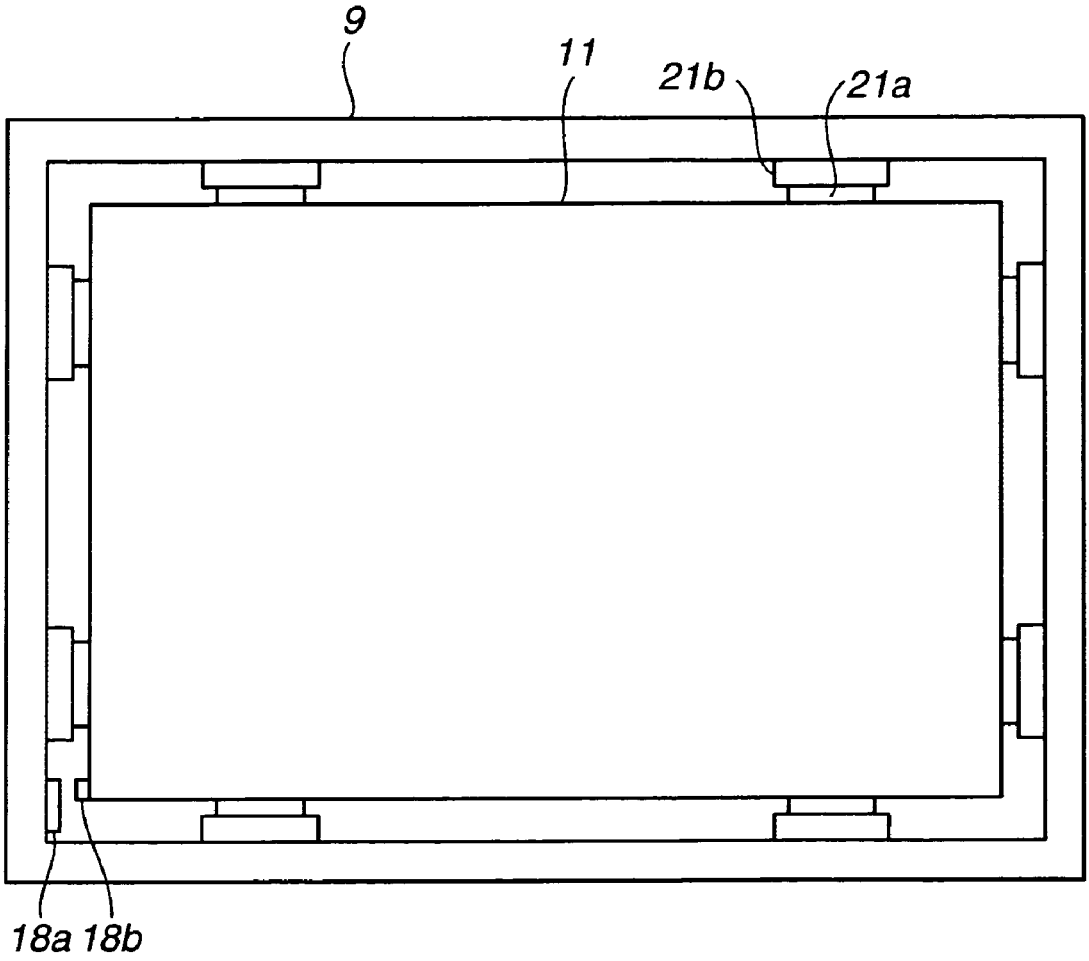
FIG. 3 is a top view of the die cushion according to the first embodiment.

FIG. 2 is a schematic view of the die cushion according to the first embodiment. FIG. 3 is a top view of the die cushion according to the first embodiment.

In the die cushion 10, the cushion pad 11 is coupled to the rotary shaft of a servomotor 16 via a ball screw 12, a coupling member 25, a large pulley 13, a belt 14 and a small pulley 15. Powers of the cushion pad 11 and the servomotor 16 are transmissible to each other. A nut portion 12*a* of the ball screw 12 is coupled to a lower portion of the cushion pad 11. A threaded portion 12*b* of the ball screw 12 is engaged with the nut portion 12*a*. A lower part of the threaded portion 12*b* is connected to the coupling member 25. The coupling member 25 is supported to the beam 6 by a bearing, etc. and its lower part is coupled to the large pulley 13. The small pulley 15 is connected to the rotary shaft of the servomotor 16. The belt 14 is wound on the large pulley 13 and the small pulley 15, and the powers of the large pulley 13 and the small pulley 15 are transmissible to each other.

The rotary type servomotor 16 has a rotary shaft that is rotated in normal and reverse directions by the supply of a current. When the current is supplied to the servomotor 16 and the rotary shaft is rotated, the small pulley 15, the large pulley 13, the coupling member 25, and the threaded portion 12*b* are rotated. As the threaded portion 12*b* is rotated, the nut portion 12*a* is linearly operated in upward and downward directions, that is, in raising and lowering directions along the threaded portion 12*b*. Then, the cushion pad 11 is raised and lowered together with the nut portion 12*a*. The energizing force applied to the cushion pad 11, that is, the cushion pressure generated in the cushion pad 11 is controlled under the current control to the servomotor 16.

Various types of measuring devices are provided in the die cushion 10. To measure a load generated in the cushion pad 11, a strain gauge 17 is adhered to a side face of the cushion pad 11. A pressure generated in the cushion pad 11 is measured by this strain gauge 17. A linear scale 18 in which a raising or lowering direction is set as a measuring direction is provided between the cushion pad 11 and the bed 9. A scale portion 18*a* of the linear scale 18 is provided on an inner wall surface of the bed 9, and a head portion 18*b* is fixed to the cushion pad 11 side closely to the scale portion 18*a*. As the cushion pad 11 is raised or lowered, the head portion 18*b* moves along the scale 18*a*. The raised or lowered position of the cushion pad 11 is measured by this linear scale 18. An encoder 19 is provided on a periphery of the rotary shaft of the servomotor 16. The rotational speed of the servomotor 16 is measured by this encoder 19. Each measured value is inputted to a pad controller 30, and a supply current to the servomotor 16 is outputted. The pad controller 30 will be described later.

Further, one or more guides 21 are provided between each side face of the cushion pad 11 and the inner wall surface of the bed 9 opposed to each side face of the cushion pad 11. The guides 21 include a pair of inner guides 21*a* and outer guides 21*b* engaged with each other. The inner guides 21*a* are provided on the side faces of the cushion pad 11, and the outer guides 21*b* are provided on the inner wall surface of the bed 9. The guides 21 guide the cushion pad 11 in the raising and lowering direction.

Then, the feedback control of the die cushion will be described.

Figure 4:
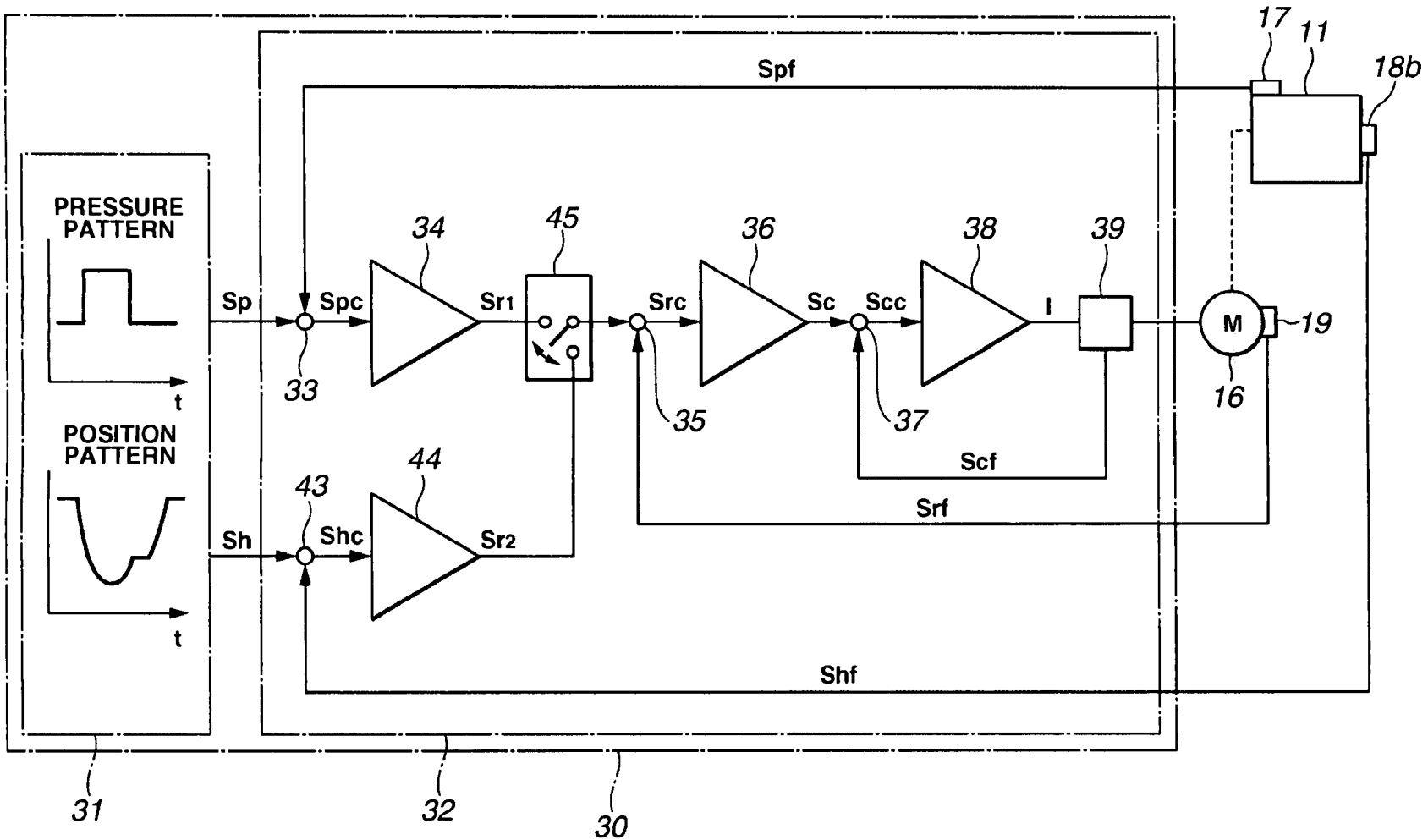
FIG. 4 is a control block diagram of feedback control performed in the first embodiment.

FIG. 4 is a control block diagram performed in the first embodiment.

The pad controller 30 has a controller 31 and an amplifier 32. In the controller 31, a pressure pattern showing a desired corresponding relation between a time (or a press angle or a slide position) and a pressure generated in the cushion pad 11, that is, a cushion pressure, and a position pattern showing a desired corresponding relation between and the time (or the press angle or the slide position) and a position of the cushion pad 11, are set. In the controller 31, the cushion pressure corresponding to the time (or the press angle or the slide position) is obtained by using the pressure pattern, and outputted as a pressure control signal Sp. The cushion position corresponding to the time (or the press angle or the slide position) is obtained by using the position pattern, and outputted as a position control signal Sh. The pressure control signal Sp, the position control signal Sh and the other measured values are inputted to the amplifier 32. A supply current I from the amplifier 32 is outputted to the servomotor 16. In the amplifier 32, any of the pressure feedback control or the position feedback control is performed, and both are switched at a predetermined timing.

It should be noted that the "pressure" of the pressure pattern includes a load applied to the cushion pad 11 and a strain occurred in a member of the cushion pad 11. Because the load and the strain are correlated with each other. In the case where the oil pressure chamber is provided, as described in the embodiments 4 and 5, the oil pressure in the oil pressure chamber may be used as the "pressure".

Here, concerning the feedback control performed in the pad controller 30, the pressure feedback control will be described first.

The pressure generated in the cushion pad 11, that is, the cushion pressure is measured by the strain gauge 17, and its value is outputted as a pressure feedback signal Spf to a pressure comparator 33. In the pressure comparator 33, a value of the pressure feedback signal Spf is compared with a value of the pressure control signal Sp, and a pressure correction signal Spc is generated. The pressure correction signal Spc is outputted to a pressure controller 34. In the pressure controller 34, a suitable speed of the servomotor 16 is obtained based on the pressure correction signal Spc, and a motor speed control signal Sr1 is generated. The motor speed control signal Sr1 is outputted to a speed comparator 35.

A rotary speed of the servomotor 16 is measured by the encoder 19, and its value is outputted as a speed feedback signal Srf to the speed comparator 35. In the speed comparator 35, a value of the motor speed control signal Sr1 (Sr2 in the case of the position feedback control) is compared with a value of the speed feedback signal Srf, and a motor speed correction signal Src is generated. The motor speed correction signal Src is outputted to the speed controller 36. In the speed controller 36, a suitable current value to the servomotor 16 is obtained based on the motor speed correction signal Src, and a current control signal Sc is generated. The current control signal Sc is outputted to a current comparator 37.

The supply current to the servomotor 16 is measured by a current detector 39, and its value is outputted as a current feedback signal Scf to the current comparator 37. In the current comparator 37, a value of the current control signal Sc is compared with a value of the current feedback signal Scf, and a current correction signal Scc is generated. The current correction signal Scc is outputted to a current controller 38. In the current controller 38, a suitable supply current I to the servomotor 16 is generated based on the current correction signal Scc. The supply current I is outputted to a current detector 39, and supplied to the servomotor 16. Then, the servomotor 16 drives the cushion pad 11. In this case, the cushion pad 11 is lowered while generating the upward energizing force. Thus, the set cushion pressure is obtained.

Then, the position feedback control will be described.

A height position of the cushion pad 11 is measured by the head portion 18*b* of the linear scale 18, and its value is outputted as a position feedback signal Shf to a position comparator 43. In the position comparator 43, a value of the position feedback signal Shf is compared with a value of a position control signal Sh, and a position correction signal Shc is generated. The position correction signal Sch is outputted to the position controller 44. In the position controller 44, a suitable speed of the servomotor 16 is obtained based on the position correction signal Shc, and the motor speed control signal Sr2 is generated. The motor speed control signal Sr2 is outputted to the speed comparator 35. A flow of the signal after the motor speed comparator 35 is the same as the pressure feedback control.

Incidentally, in the pad controller 30, functions up to the speed controller 36 may be incorporated in the controller 31 side, and functions after the current comparator 37 may be incorporated in the amplifier 32 side.

The pressure feedback control and the position feedback control are switched by a switch operation of a switching unit 45. In this embodiment, when a first switching time in which the upper die is contacted with the work, is detected, the position feedback control is switched to the pressure feedback control. When a second switching time in which the cushion pad 11 reaches the bottom dead point, is detected, the pressure feedback control is switched to the position feedback control.

The first switching time is a time when the measured value of the strain gauge 17 reaches a first threshold value at the time the cushion pad 11 is lowered (when the upper die is contacted with the work and the pressure of the cushion pad 11 starts generating), or a time when the measured value of the head portion 18*b* of the linear scale 18 reaches a first predetermined position (when the cushion pad 11 reaches the position where the upper die is contacted with the work). The second switching time is a time when the measured value of the strain gauge 17 reaches a second threshold value at the time the cushion pad 11 is lowered (when the upper die is separated from the work and the pressure of the cushion pad 11 is vanished), or the measured value of the head portion 18*b* of the linear scale 18 reaches a second predetermined position (when the cushion pad 11 reaches the bottom dead point).

Then, the relationship between an operation of the cushion pad 11 and the pressure and position feedback controls will be described by using FIG. 4 and FIG. 5.

Figure 5:
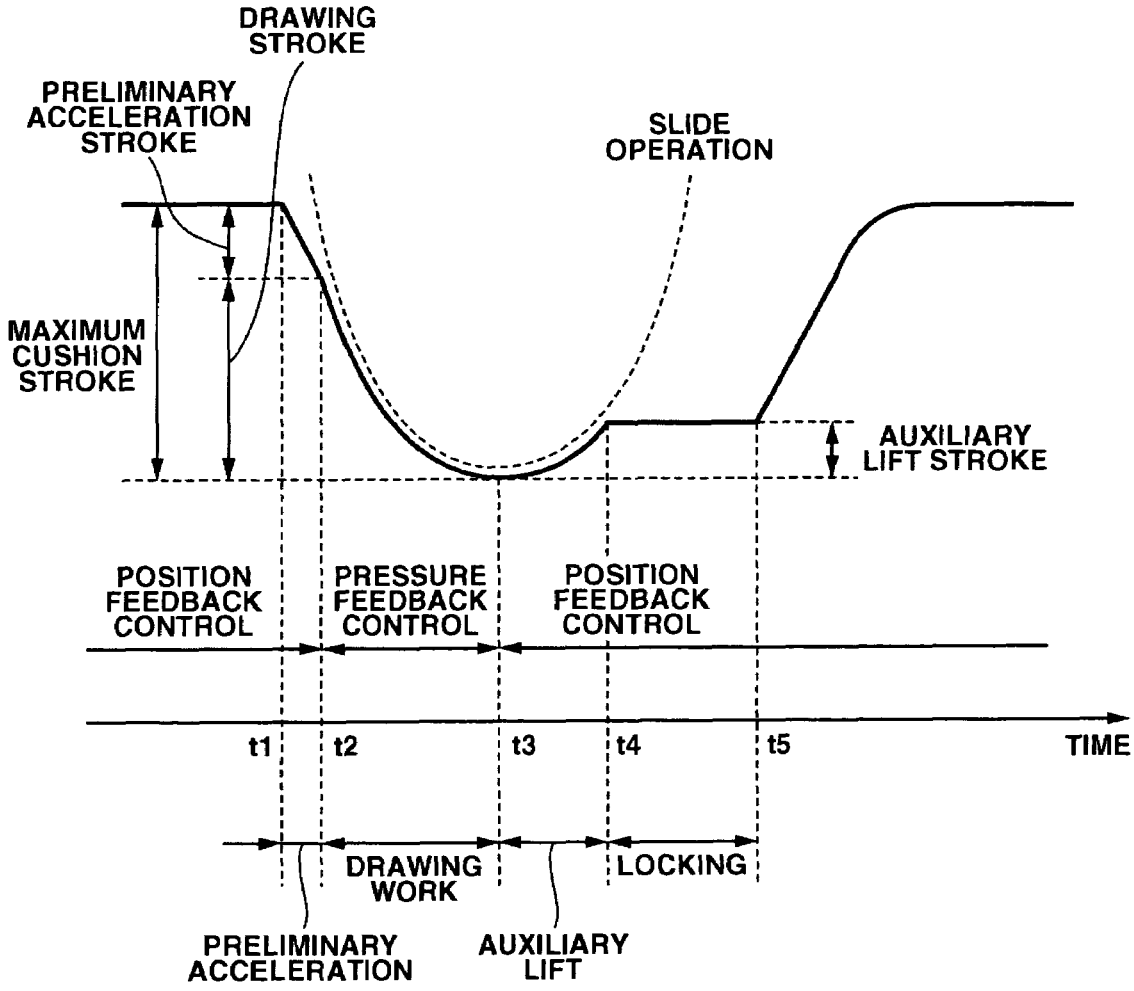
FIG. 5 is a view showing an operation of a slide and a die cushion pad.

FIG. 5 is a view showing an operation of the slide and the die cushion pad, which shows positional changes of the slide and the cushion pad along with the passage of time.

In the press machine, to alleviate the impact when the upper die is contacted with the work, the cushion pad 11 is preliminarily accelerated. Between a time t1 and a time t2, the preliminary acceleration is performed. During this period, the position feedback control is performed in the pad controller 30, and the position of the cushion pad 11 is controlled so that the position measured value follows the preset position pattern. The cushion pad 11 is lowered in response to its result.

At the time t2 (first switching time), the upper die is contacted with the work. At this time, the switch is switched in the switching unit 45 of the pad controller 30, and the position feedback control is switched to the pressure feedback control. Between the time t2 and a time t3, the slide 2 is lowered together with the cushion pad 1, and the work is drawn. During this period, the pressure feedback control is performed in the pad controller 30, and the energizing force applied to the cushion pad 11 is controlled so that the pressure measured value follows the preset pressure pattern. The cushion pad 11 is lowered in response to the result thereof. At the time t3 (second switching time), the slide 2 and the cushion pad 11 reach the bottom dead point. At this time, the switch is switched in the switching unit 45 of the pad controller 30 and the pressure feedback control is switched to the position feedback control. Between the time t3 and a time t4, the slide 2 and the cushion pad 11 are raised together for an amount of an auxiliary lift. Between the time t4 and a time t5, the cushion pad is locked, and a raising operation is temporarily stopped. At the time t5, the cushion pad 11 again starts raising. As described above, after the time t3, the position feedback control is performed in the pad controller 30, and the position of the cushion pad 11 is controlled so that the position measured value follows the preset position pattern. The cushion pad 11 is raised in response to the result thereof.

In this embodiment, a pressure generated in the cushion pad 11, that is, the cushion pressure is measured, and the pressure feedback control is performed, but the feedback control based on the energizing force applied to the cushion pad 11 is considered to be one type of the pressure feedback control.

According to the first embodiment, since the pressure feedback control of the closed loop for feeding back the cushion pressure measured from the cushion pad itself is performed at a timing necessary for the pressure feedback of the cushion pad, the cushion pressure of the cushion pad can be controlled in high accuracy Therefore, the workability of the press can be improved.

Incidentally, the present invention can be applied to various types of die cushion. Part of them will be described in a second embodiment to a sixth embodiment.

Second Embodiment

Figure 6:
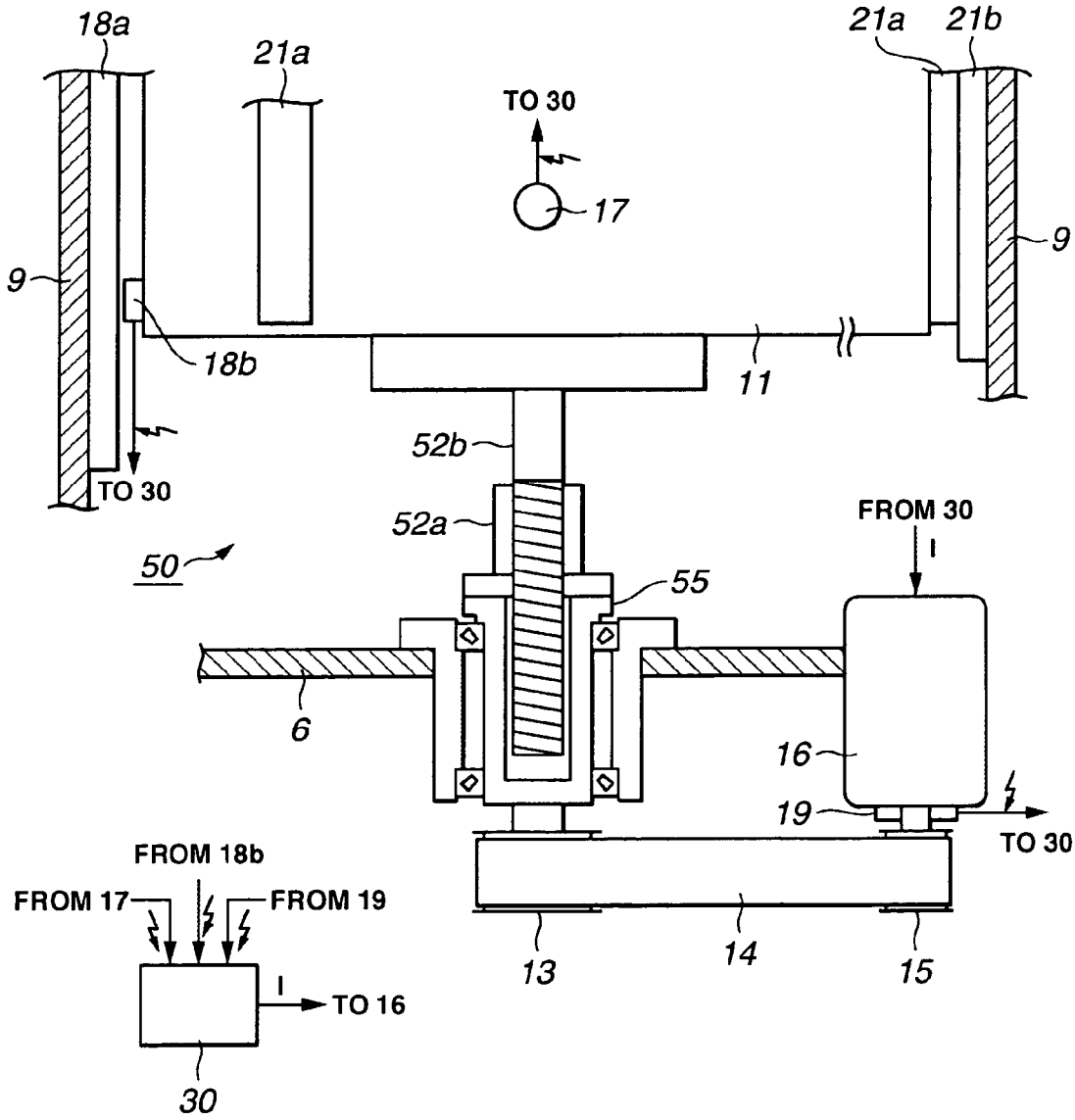
FIG. 6 is a schematic view of the die cushion according to a second embodiment.

FIG. 6 is a schematic view of a die cushion according to the second embodiment. Concerning the die cushion 50 shown in FIG. 6, only different portion from the die cushion 10 shown in FIG. 2 will be described.

In the die cushion 50, the cushion pad 11 is coupled to a rotary shaft of the servomotor 16 via a ball screw 52, a coupling member 55, a large pulley 13, a belt 14 and a small pulley 15. Between the cushion pad 11 and the servomotor 16, powers are transmissible to each other. The threaded portion 52*b* of the ball screw 52 is coupled to the lower portion of the cushion pad 11. The threaded portion 52*b* of the ball screw 52 is engaged with a nut portion 52*a*. A lower part of the nut portion 52*a* is connected to the coupling member 55. The coupling member 55 is supported by a bearing, etc. to the beam 6, and its lower portion is coupled to the large pulley 13. The small pulley 15 is connected to the rotary shaft of the servomotor 16. A belt 14 is wound around the large pulley 13 and the small pulley 15 and their powers are transmissible to each other.

When a current is supplied to the servomotor 16 and the rotary shaft is rotated, the small pulley 15, the large pulley 13, the coupling member 55, and the nut portion 52*a* are rotated. As the nut portion 52*a* is rotated, the threaded portion 52*b* is linearly moved in a vertical direction, that is, in a raised or lowered direction along the nut portion 52*a*. Then, the cushion pad 11 is raised or lowered together with the threaded portion 52*b*. The energizing force applied to the cushion pad 11 under the current control of the servomotor 16, that is, the cushion pressure generated in the cushion pad 11 is controlled.

In the die cushion 50, the strain gauge 17, the linear scale 18, the encoder 19, and the pad controller 30 are similar to those in the die cushion 10 of the first embodiment. In the pad controller 30, the feedback control similar to the feedback control of the first embodiment is performed.

According to the second embodiment, the similar effects to those of the first embodiment can be obtained.

Third Embodiment

Figure 7:
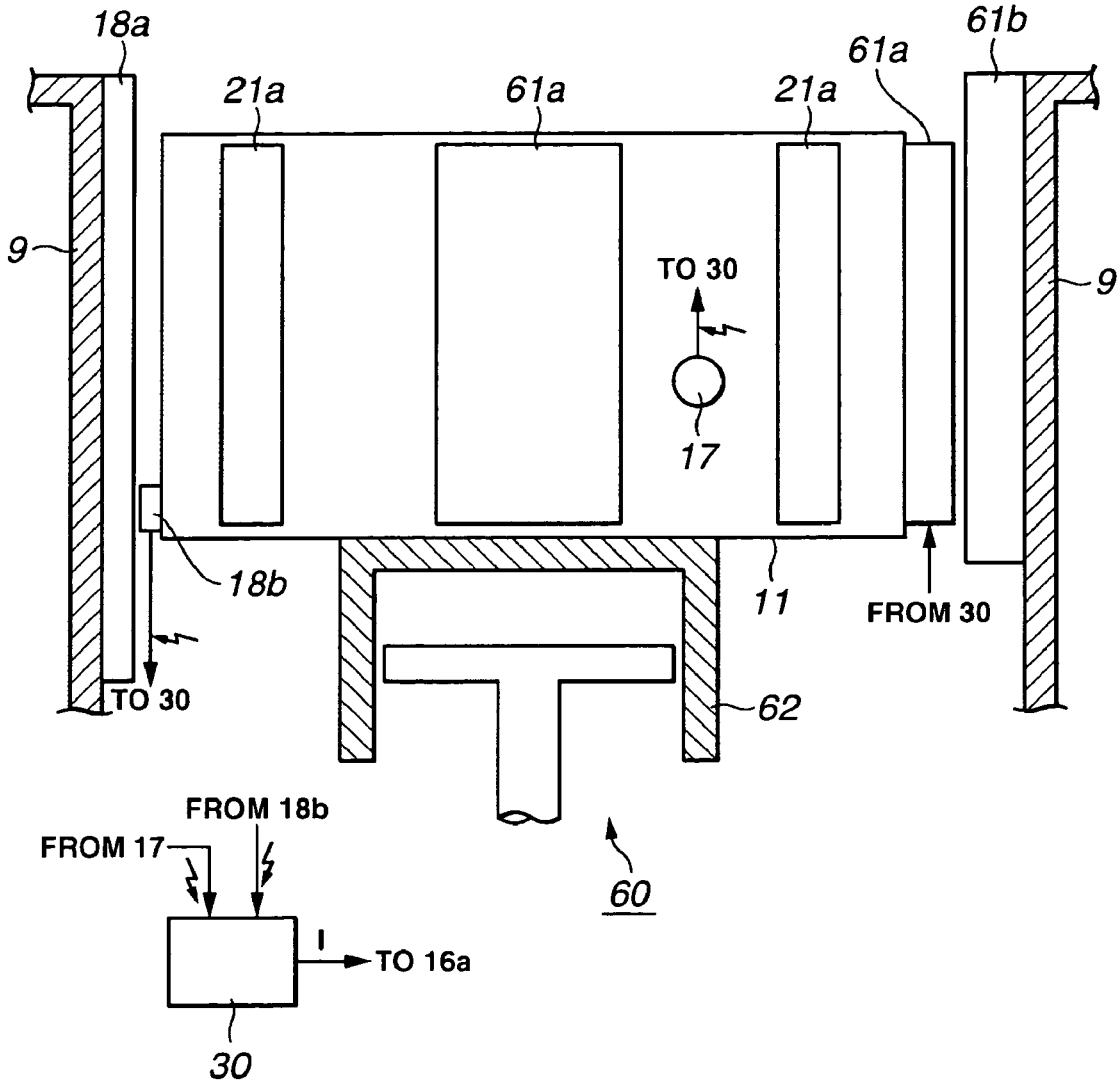
FIG. 7 is a schematic view of the die cushion according to a third embodiment.
Figure 8:
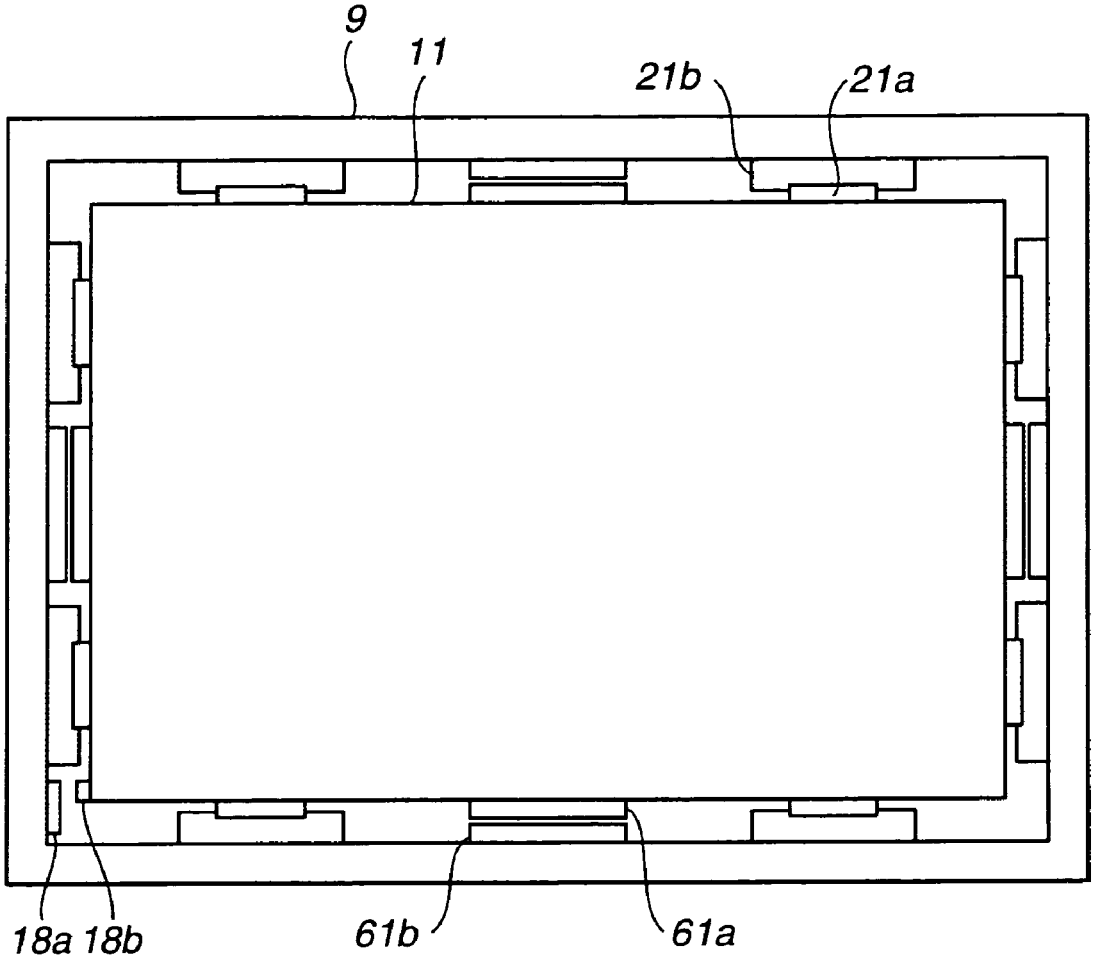
FIG. 8 is a top view of the die cushion according to the third embodiment.

FIG. 7 is a schematic view of a die cushion according to a third embodiment. FIG. 8 is a top view of the die cushion according to the third embodiment. Concerning the die cushion 60 shown in FIG. 7 and FIG. 8, only a portion different from the die cushion 10 shown in FIG. 2 will be described.

A linear servomotor 61 is provided between each side face of the cushion pad 11 and each inner wall surface of the bed 9 opposed to the side face of the cushion pad 11. The linear servomotor 61 includes a pair of a coil portion 61*a* and a magnet portion 61*b*. The coil portion 61*a* is provided on each side face of the cushion pad 11, and the magnet portion 61*b* is provided on the inner wall surface of the bed 9. Contrarily, the magnet portion 61*b* may be provided on each side face of the cushion pad 11, and the coil portion 61*a* may be provided on the inner wall surface of the bed 9. Incidentally, in FIG. 7, the linear servomotor 61 is shown only on the right side face of the cushion pad 11 and the facing inner wall surface of the bed 9. However, actually, the linear servomotor 61 is provided on each side face of the cushion pad 11 and the facing inner wall surface of the opposed bed 9, as shown in FIG. 8.

In the case that the coil portion 61*a* is provided in the cushion pad 11, when the coil portion 61*a* is excited, an attraction force and a repelling force act between the coil portion 61*a* and the magnet portion 61*b*, thereby the coil portion 61*a* and the cushion pad 11 receive an energizing force of a raising and lowering direction. In the case that the magnet portion 61*b* is provided in the cushion pad 11, when the coil portion 61*a* is excited, the attraction force and the repelling force act between the coil portion 61*a* and the magnet portion 61*b*, thereby the magnet portion 61*b* and the cushion pad 11 receive an energizing force of the raising and lowering direction. When the supply current to the coil portion 61*a* is controlled, the energizing force applied to the cushion pad 11, that is, the cushion pressure generated in the cushion pad 11 is controlled.

An air pressure type balancer 62 having a piston and a cylinder is provided in the lower portion of the cushion pad 11. Though not shown, the piston of the balancer 62 is supported at a lower portion by the beam 6. Thus, since the cushion pad 11 is supported by the beam 6 via the balancer 62, even if a magnetic force between the coil portion 61 and the magnet portion 61*b* is eliminated as a power source of the linear servomotor 61 is cut off, the cushion pad 11 does not drop down.

In the die cushion 60, the strain gauge 17, the linear scale 18, and the pad controller 30 are similar to those in the die cushion 10 of the first embodiment.

Concerning the feedback control, it is basically the same as the die cushion 10 of the first embodiment. However, since the rotary type servomotor and the linear drive type servomotor are different in structures, a feedback control system of the motor speed is slightly different. Here, only that difference will be described.

Figure 9:
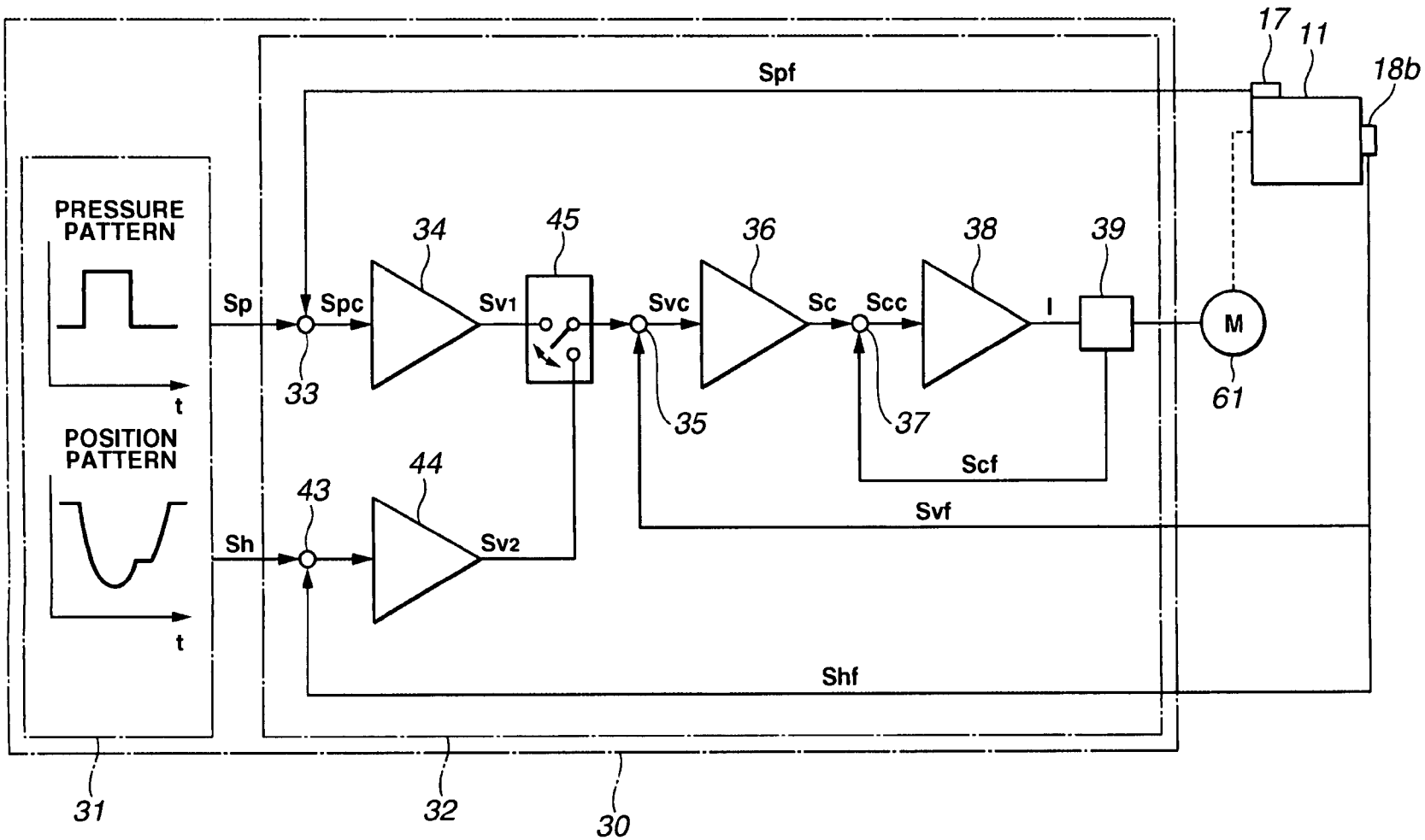
FIG. 9 is a control block diagram of feedback control performed in the third embodiment.

FIG. 9 is a control block diagram of the feedback control performed in the third embodiment.

The speed of the linear servomotor 61 is a relative speed of the coil portion 61*a* to the magnet portion 61*b*. That is, a raising or lowering speed of the cushion pad 11. The raising or lowering speed of the cushion pad 11 is obtained by differentiating a displacing amount with respect to time. The raising or lowering speed is differentiated based on a position signal measured by the head portion 18*b*, and its value is outputted as a speed feedback signal Svf to the speed comparator 35. In the speed comparator 35, a value of the motor speed control signal Sv1 (Sv2 in the case of the position feedback control) is compared with a value of the speed feedback signal Svf, and a motor speed correction signal Svc is generated. The motor seed correction signal Svc is outputted to the speed controller 36. In the speed controller 36, a suitable current value to the servomotor 16 is obtained based on the motor speed correction signal Svc, and a current control signal Sc is generated. The current control signal Sc is outputted to the current comparator 37.

Incidentally, the pressure feedback control system and the current feedback control system are similar to those in the first embodiment.

According to the third embodiment, the similar effects to the first embodiment can be obtained.

According to the third embodiment, a power transmission between the servomotor and the cushion pad is not performed by a mechanical contact using an engaging member, such as a gear, a belt, a ball screw, etc., but is performed by non-contact using a magnetic force. Therefore, a mechanical sound in the power transmission is eliminated and an operating sound of the press machine is reduced.

According to the third embodiment, the number of components is reduced as compared with the case of using the rotary servomotor. Therefore, maintenance of the die cushion is facilitated.

Fourth Embodiment

Figure 10:
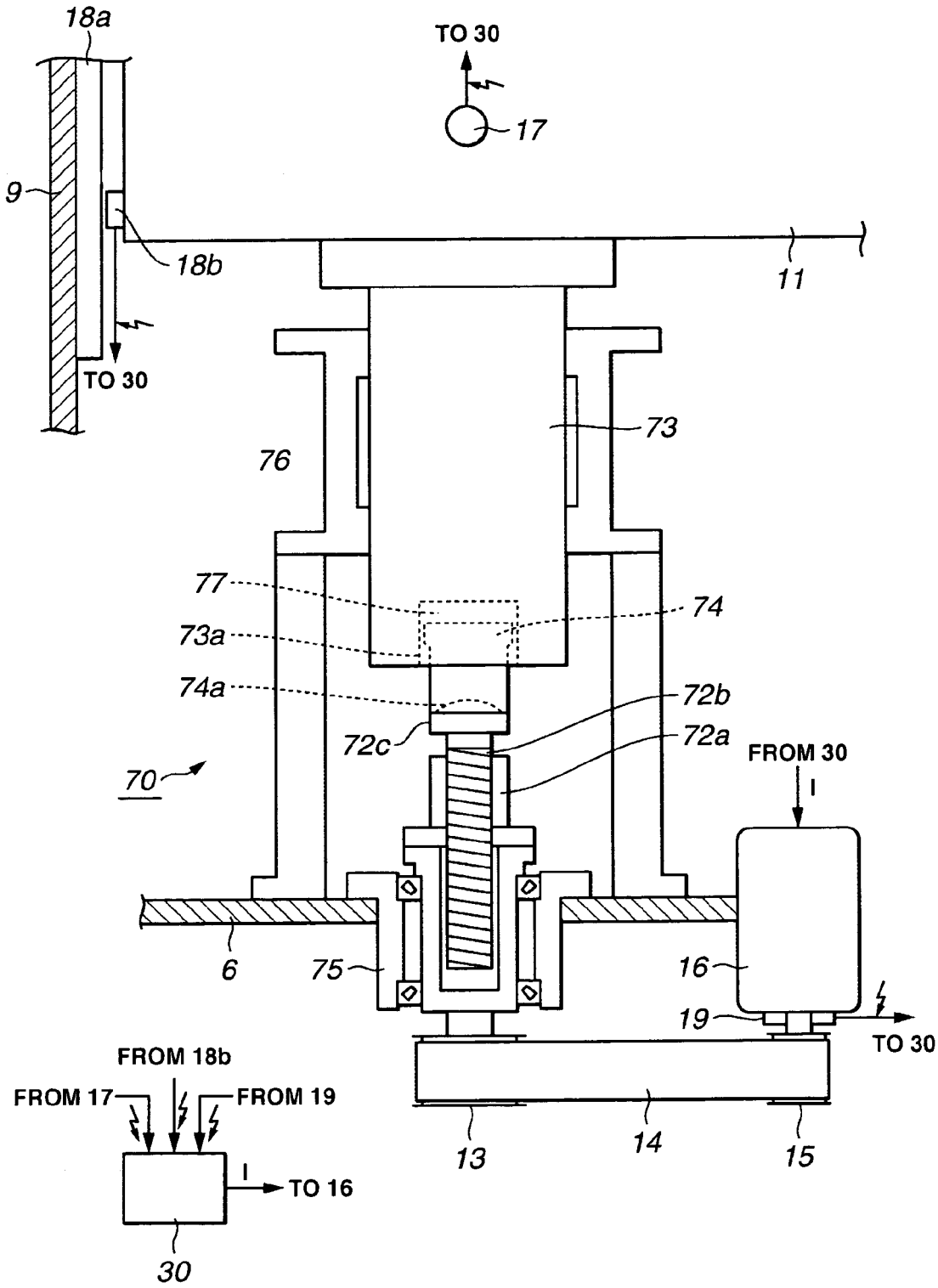
FIG. 10 is a schematic view of the die cushion according to a fourth embodiment.

FIG. 10 is a schematic view of the die cushion according to a fourth embodiment. Concerning the die cushion 10 shown in FIG. 10, only a portion different from the cushion 10 shown in FIG. 2 will be described.

In the die cushion 70, the cushion pad 11 is coupled to the rotary shaft of the servomotor 16 via a plunger rod 73, a piston 74, a ball screw 72, a coupling member 75, a large pulley 13, a belt 14 and a small pulley 15. Between the cushion pad 11 and the servomotor 16, powers are transmissible to each other.

The columnar plunger rod 73 is connected to the lower portion of the cushion pad 11. The plunger rod 73 is slidably supported at its side face by a cylindrical plunger guide 76. The plunger guide 76 is mountable on the beam 6. When the plunger guide 76 is fixed to the beam 6, the plunger rod 73 is raised or lowered while being supported by the plunger guide 76. The plunger guide 76 guides the plunger rod 73 and the cushion pad 11 coupled to the plunger rod 73 in a raising or lowering direction.

A cylinder 73*a* having an opening in a downward direction is formed in a lower portion of the plunger rod 73, and the piston 74 is slidably contained in the cylinder 73*a*. An oil pressure chamber 77 is formed by the inner wall surface of the cylinder 73*a* and the upper face of the piston 74, and pressure oil is filled in this oil pressure chamber 77. The axial center of the oil pressure chamber 77 is the same as those of the plunger rod 73 and the ball screw 72. The pressure oil for alleviating an impact is filled in the oil pressure chamber 77. The pressure oil in the oil pressure chamber 77 alleviates the impact generated when the upper die contacts with the work.

Figure 11:
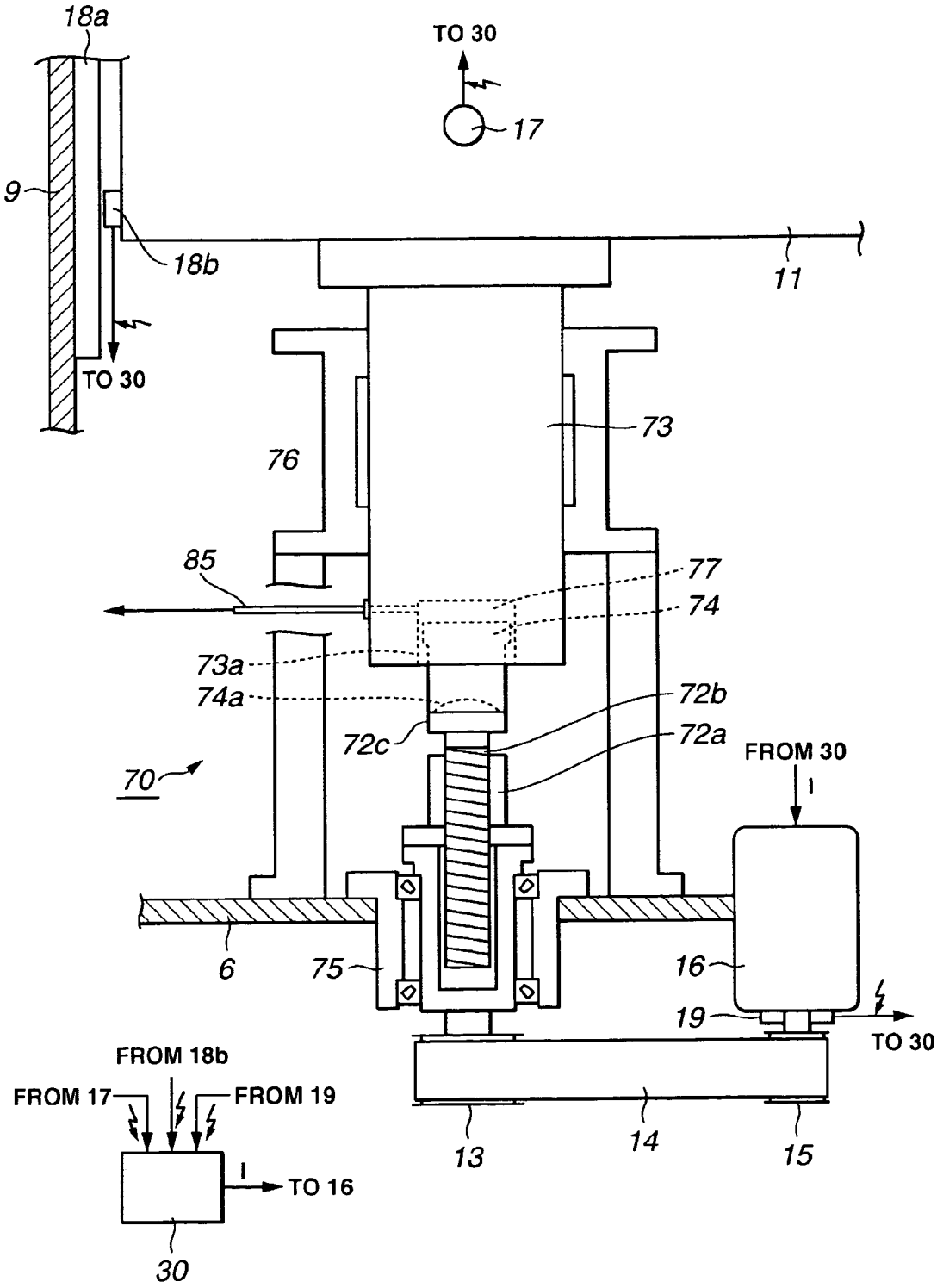
FIG. 11 is a schematic view of the die cushion according to another form of the fourth embodiment.
Figure 12:
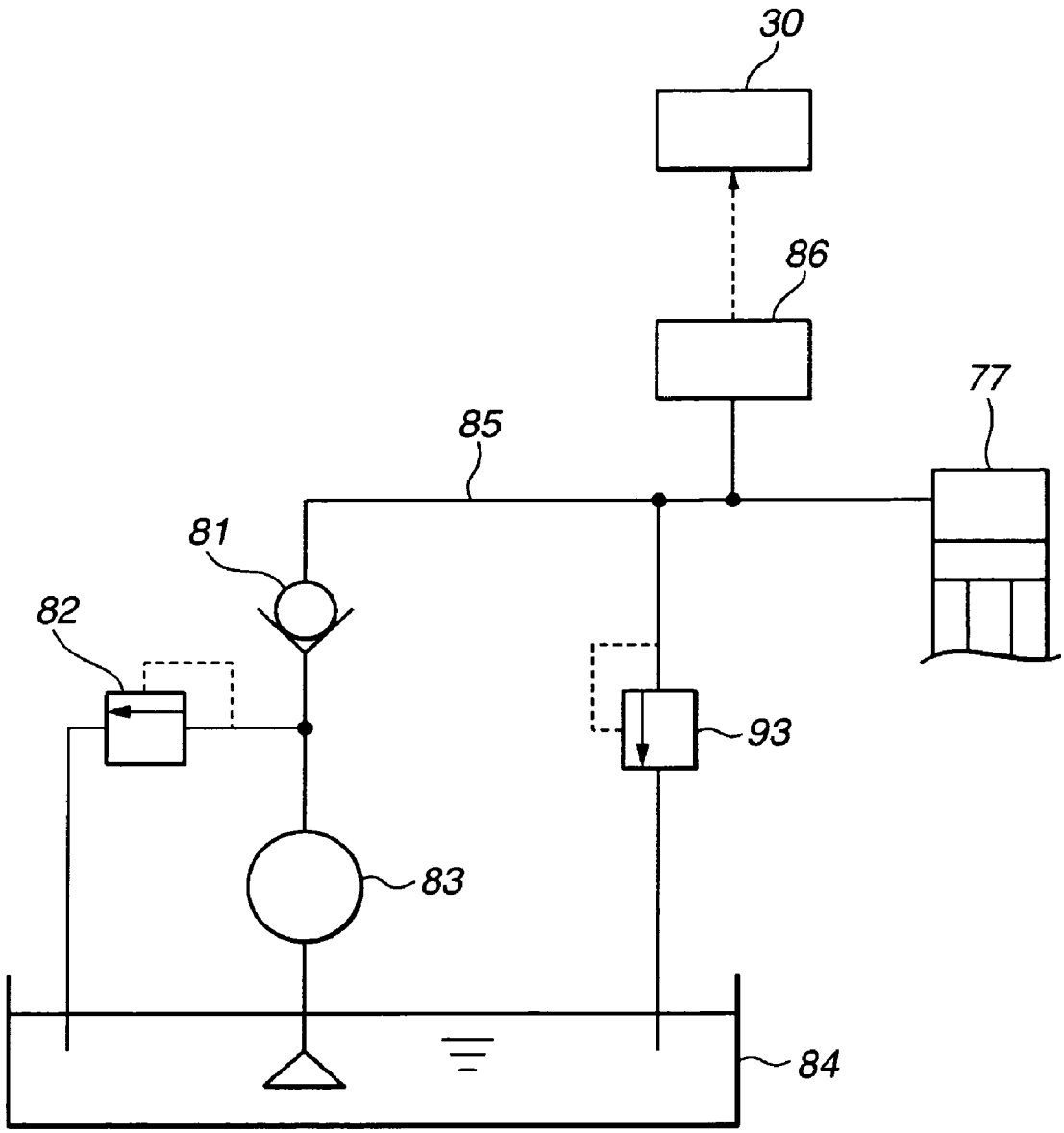
FIG. 12 is an oil pressure circuit diagram according to a fifth embodiment.
Figure 14:
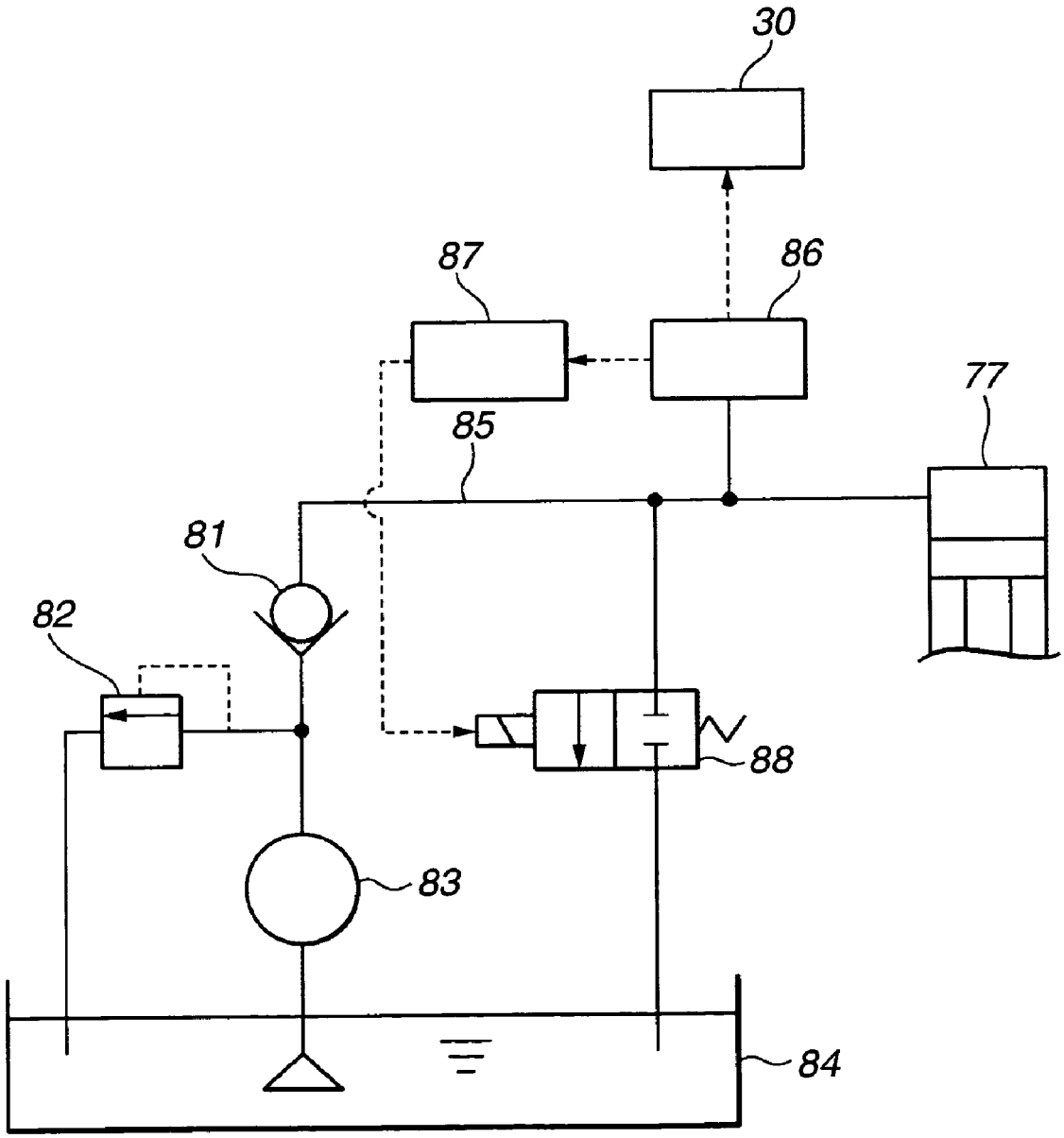
FIG. 14 is an oil pressure circuit diagram according to another form of the fifth embodiment.
Figure 15:
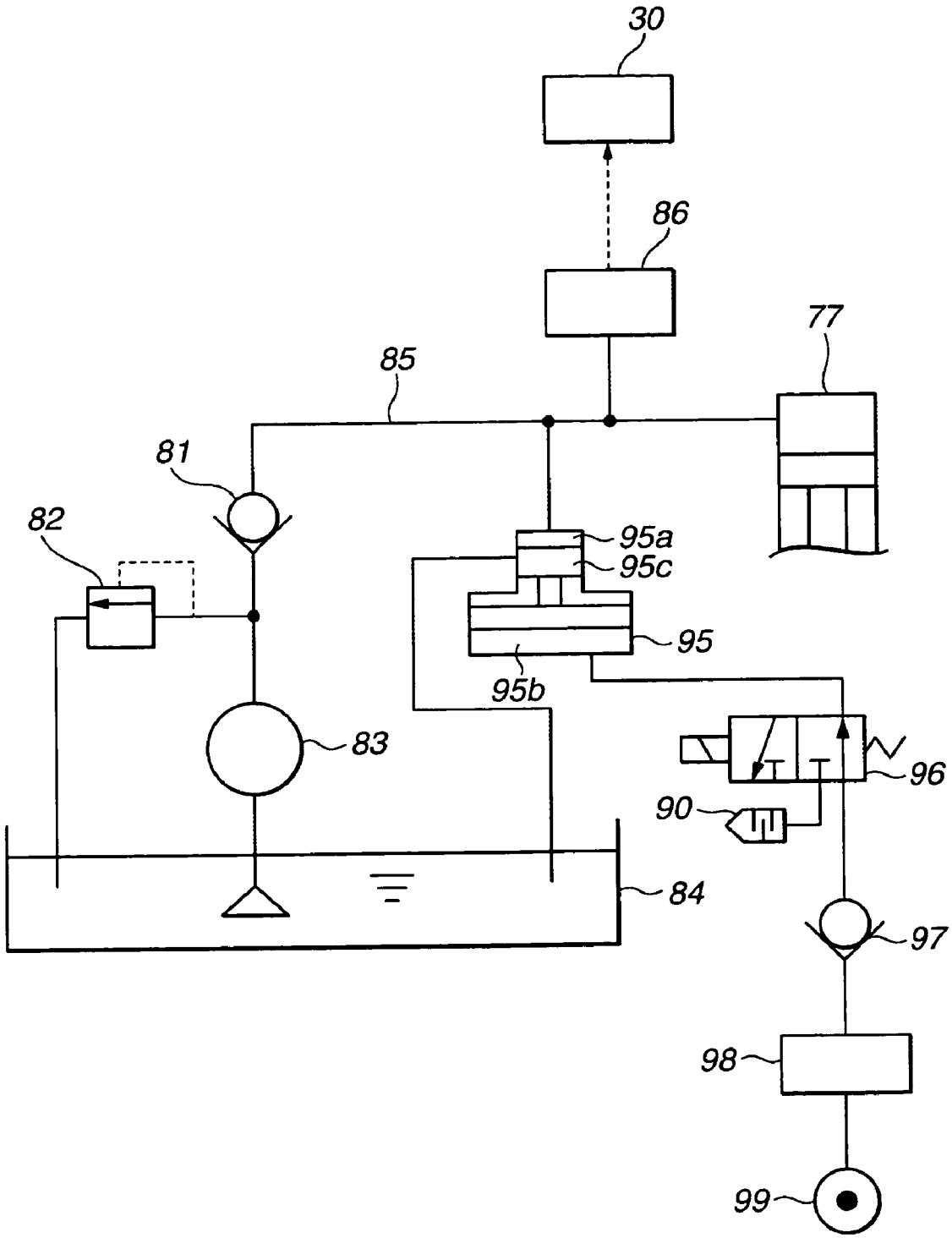
FIG. 15 is an oil pressure circuit diagram according to another form of the firth embodiment.

As shown in FIG. 11, it may be arranged that a conduit 85 is communicated with the oil pressure chamber 77 to supply the pressure oil to the oil pressure chamber 77 and discharge the pressure oil from the oil pressure chamber 77. An oil pressure circuit shown in FIG. 12, FIG. 14 and FIG. 15 is connected to the oil pressure chamber 77 via the conduit 85. Details of these oil pressure circuits will be described with reference to the fifth embodiment.

A lower end of the piston 74 is contacted with an upper end of the threaded portion 72*b* of the ball screw 72. A spherical recess surface 74*a* is formed on the lower end of the piston 74, and a spherical protruding surface 72*c* is formed on the upper end of the threaded portion 72*b* opposed to this recess surface 74*a*. Contrarily, a protruding surface is formed on the lower end of the piston 78, and a recess surface may be formed on the upper end of the threaded portion 72*b*. A bar-like member like the threaded portion 72*b* is strong against the axial force acting on the end portion, but is weak to a bending moment. When the upper end of the threaded portion 72*b* is formed in a spherical shape, even if the cushion pad 11 is inclined so that the bending moment is generated at the upper end of the threaded portion 72*b*, only the axial force acts on the entire threaded portion 72*b*. A damage of the threaded portion 72*b* due to an eccentric load can be prevented by such a structure.

A coupling member 75 is interposed between the nut portion 72*a* of the ball screw 72 and the large pulley 13 and the coupling member 75 is supported to the beam 6 by a bearing, etc. The small pulley 15 is connected to the rotary shaft of the servomotor 16. A belt 14 is wound on the large pulley 13 and the small pulley 15, and their powers are transmissible to each other.

When a current is supplied to the servomotor 16 and the rotary shaft is rotated, the small pulley 15 and the large pulley 13 are rotated. Since the large pulley 13, the coupling member 75 and the nut portion 72*a* are integral, the nut portion 72*a* is rotated along with the rotation of the large pulley 13. As the nut portion 72*a* is rotated, the threaded portion 72*b* linearly moves along the nut portion 72*a* in a vertical direction, that is, in a raising or lowering direction. The cushion pad 11 is raised or lowered together with the threaded portion 72*b*, the piston 74 and the plunger rod 73. The energizing force applied to the cushion pad 11, that is, the cushion pressure generated in the cushion pad 11 is controlled under the current control to the servomotor 16.

In the die cushion 70, concerning the strain gauge 17, the linear scale 18, the encoder 19 and the pad controller 30 are similar to those of the die cushion 10 of the first embodiment. In the pad controller 30, a feedback control similar to the feedback control of the first embodiment is performed.

Incidentally, the strain gauge 17 may be provided on a side face of the plunger rod 73, not on a side face of the cushion pad 11.

According to the fourth embodiment, the similar effects to those in the first embodiment can be obtained.

Fifth Embodiment

Concerning the die cushion 70 shown in FIG. 11, it may also be considered to measure a pressure in the oil pressure chamber 77, not measuring a pressure generated in the cushion pad 11 by the strain gauge 17.

Figure 13:
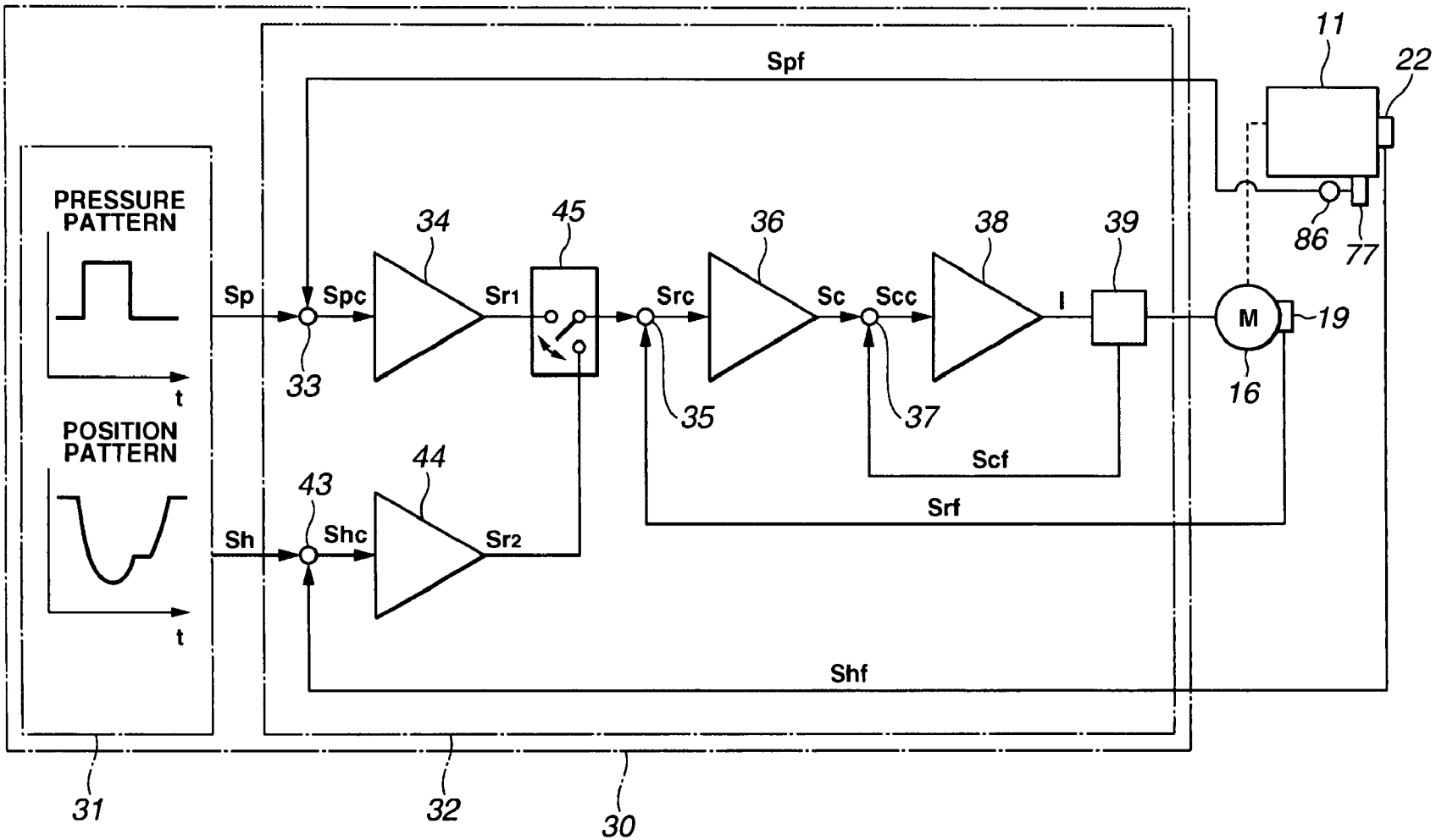
FIG. 13 is a control block diagram of feedback control performed in the fifth embodiment.

FIG. 12 is an oil pressure circuit diagram according to a fifth embodiment. FIG. 13 is a control block diagram of the feedback control performed in the firth embodiment.

The pressure oil discharge port of an oil pressure pump 83 communicates with a pressure oil port of the oil pressure chamber 77 via a check valve 81 and a conduit 85. A branch conduit is connected to a conduit between the oil pressure pump 83 and the check valve 81, and this branch conduit communicates with a relief valve 82. Further, the relief valve 82 communicates with a tank 84. The pressure oil discharged from the oil pressure pump 83 is set to a predetermined pressure by the relief valve 82, and the residual pressure oil is returned to the tank 84. Incidentally, by the check valve 81, the pressure change in the oil pressure chamber 77 does not affect influence directly to the oil pressure pump 83.

A branch conduit is connected to the conduit 85, and this branch conduit communicates with the relief valve 93. Furthermore, the relief valve 93 communicates with the tank 84. In the relief vale 93, the maximum oil pressure for preventing overloading is set as a relief pressure. When the oil pressure in the oil pressure chamber 77 reaches the maximum oil pressure, the relief valve 93 is opened, and the pressure oil in the conduit 85 is returned to the tank 84 via the relief valve 93. Then, the oil pressure in the conduit 85 lowers. When a measured value of a pressure sensor 86 becomes a predetermined pressure or lower, a controller, not shown, emergency stops the press machine. Therefore, the pressure oil in the conduit 85 is discharged to the tank 84 to thereby prevent overloading.

The pressure sensor 86 is provided in the conduit 85. The pressure in the oil pressure chamber 77, that is, a load generated in the cushion pad 11 is measured by the pressure sensor 86. The measured value of the pressure sensor 86 is outputted to the pad controller 30. The feedback control shown in the control block diagram of FIG. 13 is fundamentally the same as the feedback control shown in the control block diagram of FIG. 4.

FIG. 14 is an oil pressure circuit diagram according to another form of the firth embodiment.

As shown in FIG. 14, a directional control valve 88 may be provided instead of the relief valve 93 of FIG. 12. Normally, the directional control valve 88 presses a spool, a poppet, etc., provided in itself by a spring force, and shuts off the conduit 85 and the tank 84. When the measured value of the pressure sensor 86 exceeds a predetermined pressure, there might be overloading. The measured value of the pressure sensor 86 is outputted to a pressure controller 87, and when the measured value exceeds a predetermined pressure, the pressure controller 87 outputs a relief signal to the directional control valve 88. The directional control valve 88 which has received the relief signal, excites a coil provided in itself. When a propulsion force by the magnetic fore exceeds the pressing force by the spring force, the spool, the poppet, etc. move. Thus, the directional control valve 88 is switched, and the conduit 85 communicates with the tank 84. Then, the oil pressure in the conduit 85 is returned to the tank 84 via the directional control valve 88. The pressure controller 87 outputs an emergency stop signal to the controller of the press machine, not shown, together with the relief signal. The controller emergency stops the press machine in response to the input of the emergency stop signal. Thus, the overloading is prevented.

FIG. 15 is also an oil pressure circuit diagram according to another form of the fifth embodiment.

As shown in FIG. 15, a protector valve 95 may be provided instead of the relief valve 93 of FIG. 12. The protector valve 95 has a small diameter oil chamber 95*a* and a large diameter air chamber 95*b*, and further has a piston 95*c* having a small diameter piston slidable in the oil chamber 95*a* and a large diameter piston slidable in the air chamber 95*b*. The conduit 85 communicates with the oil chamber 95*a*. The air chamber 95*b* communicates with an air pressure source 99 via a directional control valve 96, a check valve 97 and a pressure regulator 98. An oil pressure port is provided at a side face of the oil chamber 95*a*. The oil pressure port communicates with the tank 84.

The air pressure in the air chamber 95*b* is set by the pressure regulator 98, so that the piston 95*c* is balanced when the oil pressure in the conduit 85 is the maximum oil pressure for preventing the overloading. That is, when the oil pressure in the conduit 85 becomes the maximum oil pressure or higher, the piston 95*c* moves to the air chamber 95*b* side. The conduit 95 communicates with the tank 94 by the movement of the piston 95*c*. Then, the pressure oil in the conduit 85 is returned to the tank 84 via the protector valve 95. When the piston 95*c* moves to the air chamber 95*b* side, a proximity switch detects the movement of the piston 95*c*, and outputs an emergency stop signal to the controller of the press machine, not shown. The controller emergency stops the press machine in response to the input of the emergency stop signal. Thus, the overloading is prevented.

Normally, the directional control valve 96 presses the spool, the poppet, etc. provided in itself by a spring force to bring the conduit 85 into communication with the tank 84. When the solenoid in the directional control valve 96 is energized, a propulsion force is generated by a magnetic force at the spool, the poppet, etc. When the propulsion force by the magnetic force exceeds the pressing force by the spring force, the spool, the poppet, etc. move. Thus, the directional control valve 96 is switched, and the air in the air chamber 95*b* is discharged to the atmosphere via a silencer 90. Then, the oil in the oil chamber 77 is returned to the tank 84. Such an operation of the directional control valve 96 is mainly performed at a maintenance time.

According to the fifth embodiment, the similar effects to the first embodiment can be obtained.

Sixth Embodiment

In the respective embodiments, the die cushion of a single piece has been described. However, a plurality of die cushions may be provided in one working station of the press machine. In this case, it is preferable to set the positional relationship between the cushion pad and its drive mechanism as follows. The positional relationship will be described with the die cushion 70' shown in FIG. 16 as an example.

Figure 16:
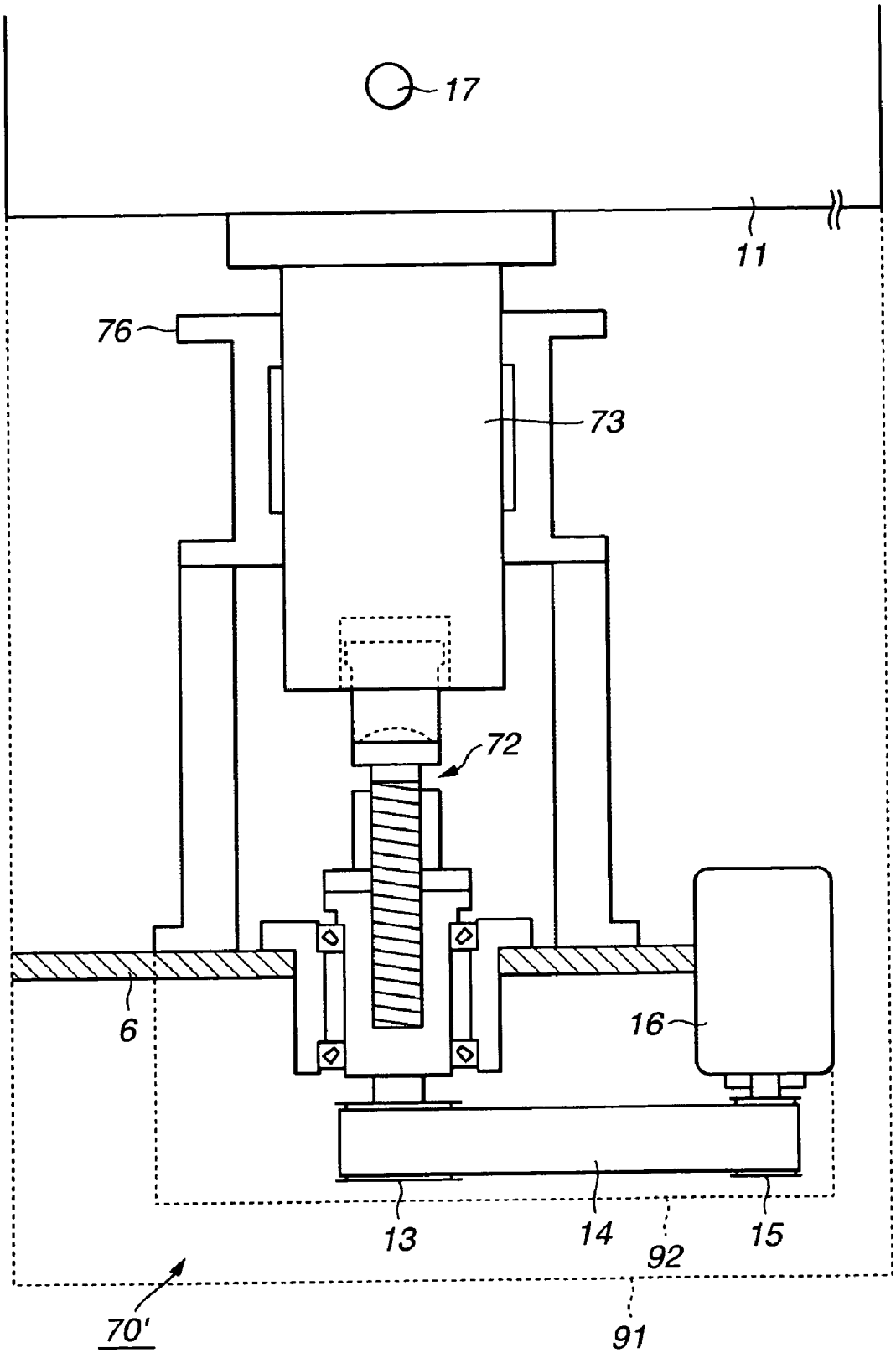
FIG. 16 is a view for explaining an arrangement of the cushion pad and its drive mechanism.

FIG. 16 is a view for explaining the positional relationship between the cushion pad and its drive mechanism.

First, there is assumed a first projected image 91 when projected from perpendicularly above of the cushion pad 11 downward to a horizontal surface. Similarly, there is also assumed a second projected image 92 when projected from perpendicularly above of the drive mechanism, such as the plunger rod 73, the plunger guide 76, the ball screw 72 and the servomotor 16, etc. disposed under the cushion pad 11. The cushion pad 11 and its drive mechanism are disposed to include all the second projected image 92 in the first projected image 91. According to this disposition, the space of the die cushion 70' in the horizontal direction does not become larger than the area of the upper surface of the cushion pad 11. That is, even if the cushion pads 11 are provided adjacently to each other, the drive mechanism of the lower portions of the respective cushion pads 11 may not interfere with each other, and a plurality of die cushions 70' can be provided adjacent to one working station.

In FIG. 16, if the projected image to downward of the servomotor 16, the belt 14 and the small pulley 15 is out of the first projected image 91, it may be possible to dispose the adjacent die cushions 70' close to each other by changing the height of the belt 14 or reversing the disposition of the servomotor 16 with each other. Thus, the area of the cushion pad 11 of the respective die cushions 70' can be further reduced, the disposition of the die cushion 70' is facilitated, and the degree of freedom of the disposition is increased.

Figure 17A:
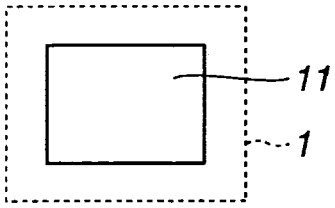
FIG. 17A to FIG. 17D are top views of one working station.
Figure 17B:
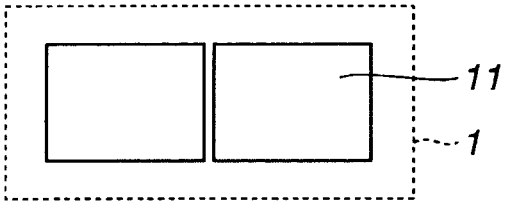
Figure 17C:
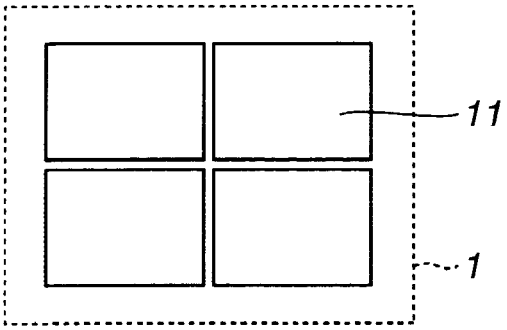
Figure 17D:
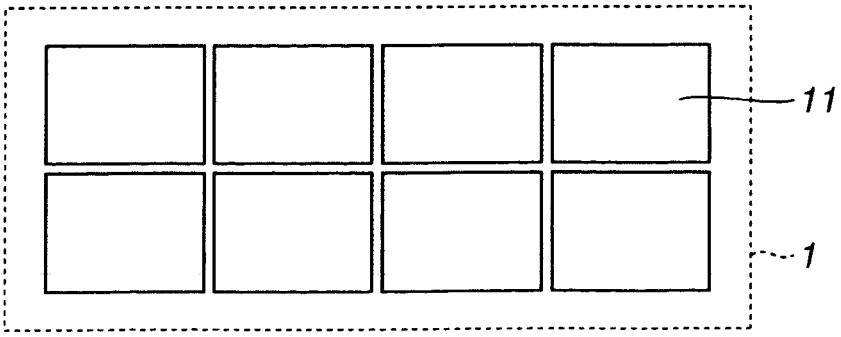
Figure 18:
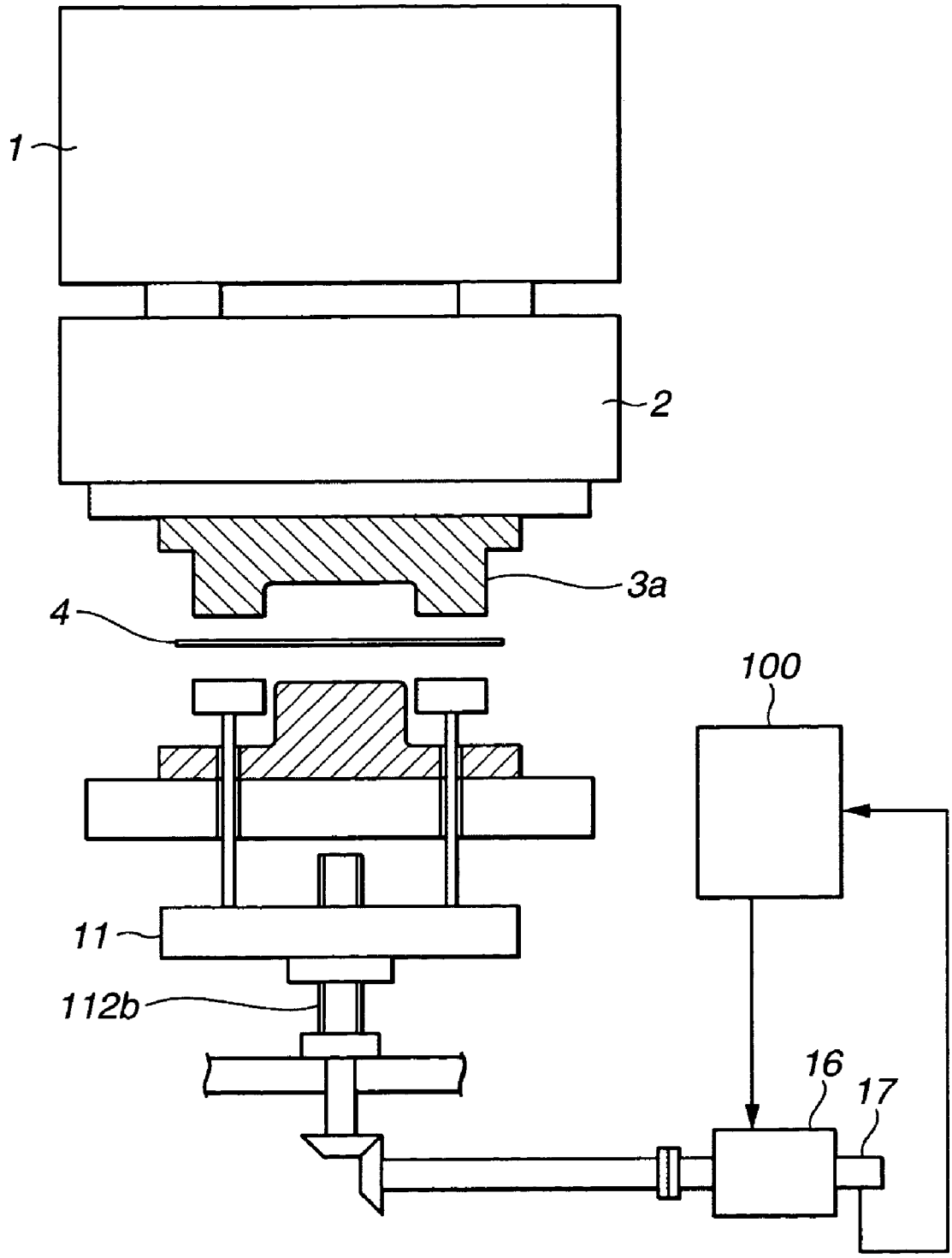
FIG.18 PRIOR ART
FIG. 18 is a view showing a conventional press machine and its control system.

FIGS. 17A to 17D are top views of one working station. In FIG. 17A, one die cushion 70' is provided in one working station of the press machine. In FIG. 17B, two die cushions 70' are provided in one working station of the press machine. In FIG. 17C, four die cushions 70' are provided in one working station of the press machine. In FIG. 17D, eight die cushions 70' are provided in one working station of the press machine.

The respective die cushions 70' are controlled independently from each other. Therefore, the cushion pressure in one working station becomes variable. Also, die cushions 70' may be interlocked.

When comparing a case where one cushion pad having a plurality of drive mechanisms is provided in one working station and the operation of this cushion pad is controlled, with a case where a plurality of cushion pads each having one drive mechanism are provided in one working station and the operation of each cushion pad is controlled, it is said that the latter case has higher independent controllability since the cushion pads are divided.

In this embodiment, as the die cushion provided in plural in one working station, the die cushion 70' equivalent to the die cushion 70 shown in FIG. 10 has been described as an example. However, it may be the die cushion 10 shown in FIG. 2, the die cushion 50 shown in FIG. 6, or the die cushion equivalent to the die cushion 60 shown in FIG. 7 may be adopted. However, in such a case, it is necessary to provide a guide member for guiding the die cushion on opposed side faces of the cushion pads 11 adjacent to each other. Since the cushion pad 70 (70') has itself the guide member, that is, the plunger guide 76 to the die cushion 10, 50, or 60, it is not necessary to provide the guide member for guiding the cushion pad 11 to each other.

According to the sixth embodiment, the effects similar to the first embodiment can be obtained. Further, according to the sixth embodiment, since the cushion pressure in one work station can be changed partially, the accuracy of the press machine can be further improved.

What is claimed is:

1. A die cushion controlling apparatus for controlling an operation of a cushion pad, comprising:

a pad drive mechanism raising and lowering the cushion pad while applying an upward energizing force;

a position measuring device measuring a position of the cushion pad;

a load measuring device measuring a load generated in the cushion pad;

a time detecting device detecting a generating time and a vanishing time of the load; and a controller controlling the pad drive mechanism, wherein the controller:

performs a position control that controls the position of the cushion pad so that a position measured value follows a preset position pattern;

performs a load control that controls the load generated in the cushion pad so that a load measured value follows a preset load pattern;

switches from the position control to the load control step at a time when the time detecting device detects a generating time of the load; and switches from the load control to the position control step at a time when the time detecting device detects a vanishing time of the load.

2. The die cushion controlling apparatus according to claim 1, wherein the load measuring device further comprises a strain gauge for measuring a strain of the cushion pad or a support for supporting the cushion pad, and wherein the load measuring device obtains a value corresponding to the load by using a measured result of the strain gauge.

3. The die cushion controlling apparatus according to claim 1, wherein the load measuring device further comprises a hydraulic chamber interposed between the cushion pad and the pad drive mechanism, and a pressure sensor for measuring a pressure in the hydraulic chamber, and wherein the load measuring device obtains a value corresponding to the load by using a measured result of the pressure sensor.

4. The die cushion controlling apparatus according to claim 1, wherein a plurality of the cushion pads, the pad drive mechanisms, the load measuring devices and the controller are provided in one working station of a press machine, and operations of the respective cushion pads are controlled independently.

5. A die cushion controlling method for controlling an operation of a cushion pad, comprising:

a position control step of measuring a position of the cushion pad and controlling the position of the cushion pad so that a position measured value follows a preset position pattern; and a load control step of measuring a load generated in the cushion pad and controlling the load generated in the cushion pad so that a load measured value follows a preset load pattern, wherein:

the position control step is switched to the load control step at a time when the load starts to be generated in the cushion pad, and the load control step is switched to the position control step at a time when the load generated in the cushion pad vanishes.

6. A die cushion controlling apparatus for controlling an operation of a cushion pad, comprising:

a pad drive mechanism raising and lowering the cushion pad while applying an upward energizing force;

a load measuring device measuring a pressure generated in the cushion pad;

a sensor measuring at least one of a lowering and raising direction and a speed of the cushion pad; and a pad controller comprising a pressure pattern, a position pattern, a pressure comparator, a pressure controller, a switching unit, a speed comparator, a speed controller, a current comparator, a current controller, a current detector, a position comparator, and a position controller, the pressure comparator receiving a pressure control signal representative of the pressure pattern and pressure feed back signal from the load measuring device, and outputting a pressure correction signal;

the pressure controller receiving the pressure correction signal and outputting a first motor speed control signal;

the position comparator receiving a position control signal representative of the control pattern and a position feedback signal from the sensor, and outputting a position correction signal;

the position controller receiving the position correction signal and outputting a second motor speed control signal;

the switching unit receiving and switching between the first motor speed control signal and the second motor speed control signal;

the speed comparator receiving output from the switching unit and receiving a speed feedback signal from the sensor, and outputting a motor speed correction signal;

the speed controller receiving the motor speed correction signal and the speed feedback signal and outputting a current control signal;

the current comparator receiving the current control signal and a current feedback signal from the current detector, and outputting a current correction signal;

the current controller receiving the current correction signal and outputting a supply current signal; and the current detector receiving the supply current signal, and outputting the current supply signal to the pad drive mechanism and the current feedback signal to the current comparator.

7. The die cushion controlling apparatus according to claim 6, further comprising a time detecting device detecting a generating time and a vanishing time of the load; and the switching unit being switched between the motor control signal and the position feedback control signal based on the generating time and the vanishing times detected by the time detecting device.

* * * * *